US010544974B2

(12) United States Patent
Goldfarbmuren et al.

(10) Patent No.: US 10,544,974 B2
(45) Date of Patent: Jan. 28, 2020

(54) SOLID PRODUCTION METHODS, SYSTEMS, AND DEVICES

(71) Applicant: Rebound Technologies, Inc., Commerce City, CO (US)

(72) Inventors: Russell Goldfarbmuren, Denver, CO (US); Luke Erickson, Denver, CO (US); Josh Nelson, Bennett, CO (US); John Darrah, Winter Park, FL (US); Mauricio Sanchez, Denver, CO (US); Chance Lord, Denver, CO (US)

(73) Assignee: Rebound Technologies, Inc., Commerce City, CO (US)

( * ) Notice: Subject to any disclaimer, the term of this patent is extended or adjusted under 35 U.S.C. 154(b) by 0 days.

(21) Appl. No.: 16/119,661

(22) Filed: Aug. 31, 2018

(65) Prior Publication Data

US 2019/0101315 A1 Apr. 4, 2019

Related U.S. Application Data

(60) Provisional application No. 62/553,738, filed on Sep. 1, 2017.

(51) Int. Cl.

| | |
|---|---|
| ***F25C 1/12*** | (2006.01) |
| ***F25D 17/02*** | (2006.01) |
| ***F25D 3/00*** | (2006.01) |

(52) U.S. Cl.

CPC ..... *F25C 1/12* (2013.01); *F25D 3/005* (2013.01); *F25D 17/02* (2013.01); *F25C 2300/00* (2013.01); *F25D 2303/084* (2013.01); *F25D 2303/085* (2013.01)

(58) Field of Classification Search

CPC ..... F25C 1/12; F25C 1/14; F25C 2400/02; F25D 3/005; F25D 17/02; F25D 2303/085; F25D 31/00

See application file for complete search history.

(56) References Cited

U.S. PATENT DOCUMENTS

| | | | |
|---|---|---|---|
| 5,858,957 | A | 1/1999 | Donoghue |
| 2017/0167770 | A1 | 6/2017 | Hemrle |

OTHER PUBLICATIONS

International Search Report and Written Opinion, Int'l Appl. No. PCT/US2018/049288, dated Dec. 26, 2018, USPTO.

*Primary Examiner* — Elizabeth J Martin

(74) *Attorney, Agent, or Firm* — Wilson Patent Law, LLC

(57) ABSTRACT

Methods, systems, and device for solidification and/or solid production, such as ice production, are provided in accordance with various embodiments. For example, some embodiments include a method of solid production that may include contacting a first fluid with a second fluid to facilitate solidifying the second fluid; the first fluid and the second fluid may be immiscible with respect to each other. The method may include solidifying the second fluid. Some embodiments include a solid production system that may include a first fluid and a second fluid; the first fluid and the second fluid may be immiscible with respect to each other. The system may include one or more surfaces configured to contact the first fluid and the second fluid with each other and to form one or more solids from the second fluid.

30 Claims, 22 Drawing Sheets

SOLID PRODUCTION METHODS, SYSTEMS, AND DEVICES

CROSS-REFERENCES TO RELATED APPLICATIONS

This application is a non-provisional patent application claiming priority benefit of U.S. provisional patent application Ser. No. 62/553,738, filed on Sep. 1, 2017 and entitled "SOLID PRODUCTION METHODS, SYSTEMS, AND DEVICES," the entire disclosure of which is herein incorporated by reference for all purposes.

GOVERNMENT LICENSE RIGHTS

This invention was made with Government support under Contract 1533939 awarded by the National Science Foundation. The Government has certain rights in the invention.

BACKGROUND

Different tools and techniques may generally be utilized for solidification and/or solid production, such as ice production, drop forming, block freezing, flake freezing, and many other devices.

There may be a need for new tools and techniques to address solidification and/or solid production.

SUMMARY

Methods, systems, and device for solidification and/or solid production, such as ice production, are provided in accordance with various embodiments.

For example, some embodiments include a method of solid production that may include contacting a first fluid with a second fluid to facilitate solidifying the second fluid; the first fluid and the second fluid may be immiscible with respect to each other. The method may include solidifying the second fluid.

In some embodiments of the method, the first fluid includes a non-polar material and the second fluid includes a polar material. In some embodiments, the first fluid includes at least hydrocarbon oil, aromatic oil, fluorinated oil, or silicone oil. In some embodiments, the second fluid includes at least water, acidic acid, formic acid, carbocyclic acids, sulfuric acid, ethylene glycol, polyethylene glycol, tert-butyl, or DMSO.

In some embodiments of the method, the first fluid includes a polar material and the second fluid includes a non-polar material. In some embodiments, the first fluid includes at least water, alcohol, propylene glycol, ethylene glycol, DMSO, ammonia, or nitric acid. In some embodiments, the second fluid includes at least fluorinated oil, cresol, high molecular weight silicon oil, high molecular weight hydrocarbon oil, high molecular weight paraffin, thermoset polymer, or metallic alloy. In some embodiments, the first fluid includes water and the second fluid includes at least high-molecular weight paraffin or thermoset polymer, for example.

In some embodiments of the method, contacting the first fluid with the second fluid includes entraining the second fluid within the first fluid. In some embodiments, the first fluid includes aromatic oil and the second fluid includes water. Some embodiments further include cooling the first fluid before entraining the second fluid within the first fluid. In some embodiments, the first fluid and the second fluid are cooled simultaneously.

In some embodiments of the method, entraining the second fluid within the first fluid includes flowing the first fluid and the second fluid through a coil to solidify at least a portion of the second fluid. In some embodiments, one or more hydrodynamic properties of the first fluid form the second fluid into one or more solidified shapes. The one or more solidified shapes may be formed with at least a predictable size or a predictable shape. One or more features of the coil may control the one or more hydrodynamic properties of the first fluid that form the second fluid into the one or more solidified shapes formed with at least the predictable size or the predictable shape. The one or more features of the coil may include at least one or more diameters of the coil, one or more geometries of the coil, one or more interior structures of the coil, one or more orientations of the coil, or one or more lengths of the coil. The one or more features of the coil may include a change in orientation of the coil. The one or more features of the coil may include a change in diameter of the coil.

In some embodiments of the method, entraining the second fluid within the first fluid includes introducing the second fluid as a parallel flow to the first fluid. In some embodiments, entraining the second fluid within the first fluid includes introducing the second fluid as a perpendicular flow to the first fluid.

In some embodiments of the method, contacting the first fluid with the second fluid includes introducing the first fluid and the second fluid with respect to one or more cold surfaces; the first fluid may have an affinity for the one or more cold surfaces. Some embodiments include removing a solidified form of the second fluid from the one or more cold surfaces. The first fluid may coat at least a portion of the one or more cold surfaces and may interfere with the second fluid from adhering to the one or more cold surfaces. In some embodiments, the first fluid includes hydrocarbon oil and the second fluid includes water.

In some embodiments of the method, contacting the first fluid with the second fluid includes mixing the second fluid with the first fluid before introducing the first fluid and the second fluid with respect to the one or more cold surfaces. In some embodiments, contacting the first fluid with the second fluid includes separately introducing the first fluid and the second fluid with respect to the one or more cold surfaces.

In some embodiments of the method, the one or more cold surfaces are comprised of a metal. Some embodiments may include other materials such as plastic, ceramic, and/or glass for the one or more cold surfaces.

In some embodiments of the method, removing the solidified form of the second fluid from the one or more cold surfaces includes utilizing an auger to remove the solidified form of the second fluid from a cylindrically-shaped cold surface. In some embodiments, removing the solidified form of the second fluid from the one or more cold surfaces includes utilizing a rotating scrapper to remove the solidified form of the second fluid from a drum-shaped cold surface. In some embodiments, removing the solidified form of the second fluid from the one or more cold surfaces includes utilizing one or more linear scrappers to remove the solidified form of the second fluid from one or more planar cold surfaces.

Some embodiments include a solid production system that may include a first fluid and a second fluid; the first fluid and the second fluid may be immiscible with respect to each other. The system may include one or more surfaces configured to contact the first fluid and the second fluid with each other and to form one or more solids from the second fluid.

In some embodiments of the system, the one or more surfaces are configured such that the first fluid and the second fluid are contacted with each other such that the second fluid is entrained within the first fluid. The one or more surfaces may include one or more coils configured to solidify at least a portion of the second fluid.

In some embodiments of the system, the one or more surfaces include one or more cold surfaces such that the first fluid has an affinity for the one or more cold surfaces. Some embodiments include one or more solid removers configured to remove a solidified form of the second fluid from the one or more cold surfaces.

In some embodiments of the system, the first fluid includes a non-polar material and the second fluid includes a polar material. In some embodiments, the first fluid includes at least hydrocarbon oil, aromatic oil, fluorinated oil, or silicone oil. In some embodiments, the second fluid includes at least water, acidic acid, formic acid, carbocyclic acids, sulfuric acid, ethylene glycol, polyethylene glycol, tert-butyl, or DMSO. In some embodiments, the first fluid includes aromatic oil and the second fluid includes water. In some embodiments, the first fluid includes hydrocarbon oil and the second fluid includes water.

In some embodiments of the system, the first fluid includes a polar material and the second fluid includes a non-polar material. In some embodiments, the first fluid includes at least water, alcohol, propylene glycol, ethylene glycol, DMSO, ammonia, or nitric acid. In some embodiments, the second fluid includes at least fluorinated oil, cresol, high molecular weight silicon oil, high molecular weight hydrocarbon oil, high molecular weight paraffin, thermoset polymer, or metallic alloy. In some embodiments, the first fluid includes water and the second fluid includes at least high-molecular weight paraffin or thermoset polymer.

Some embodiments of the system include a heat exchanger positioned to cool the first fluid before entraining the second fluid within the first fluid. In some embodiments, the first fluid and the second fluid are cooled simultaneously within the one or more coils. In some embodiments of the system, one or more hydrodynamic properties of the first fluid within the one or more coils form the second fluid into one or more solidified shapes. In some embodiments of the system, the one or more solidified shapes are formed with at least a predictable size or a predictable shape. In some embodiments, one or more features of the coil control the one or more hydrodynamic properties of the first fluid that form the second fluid into the one or more solidified shapes formed with at least the predictable size or the predictable shape. In some embodiments, the one or more features of the coil include at least one or more diameters of the coil, one or more geometries of the coil, one or more interior structures of the coil, one or more orientations of the coil, or one or more lengths of the coil. In some embodiments, the one or more features of the coil include a change in orientation of the coil. In some embodiments, the one or more features of the coil include a change in diameter of the coil.

Some embodiments of the system include a mixing nozzle configured to entrain the second fluid within the first fluid. Some embodiments include a tube positioned within the mixing nozzle such that the second fluid is introduced as a parallel flow to the first fluid. Some embodiments include a tube positioned within the mixing nozzle such that the second fluid is introduced as a perpendicular flow to the first fluid.

In some embodiments of the system, the first fluid coats at least a portion of the one or more cold surfaces and interferes with the second fluid from adhering to the one or more cold surfaces. Some embodiments include a first storage container configured to hold the first fluid and a second storage container configured to hold the second fluid. Some embodiments include a combiner configured to combine the first fluid from the first storage container with the second fluid from the second storage container for delivery to the one or more cold surfaces. Some embodiments include a first conduit coupled with the first storage container and a second conduit coupled with the second storage container; the first conduit and the second conduit may be configured to deliver the first fluid and the second fluid separately to the one or more cold surfaces. In some embodiments, the first conduit is coupled with the one or more solid removers to facilitate delivery of the first fluid to the one or more cold surfaces.

In some embodiments of the system, the one or more cold surfaces are comprised of a metal. Some embodiments may include other materials such as plastic, ceramic, and/or glass for the one or more cold surfaces.

In some embodiments of the system, the one or more solid removers configured to remove the solidified form of the second fluid from the one or more cold surfaces include an auger to remove the solidified form of the second fluid from a cylindrically-shaped cold surface. In some embodiments, the one or more solid removers configured to remove the solidified form of the second fluid from the one or more cold surfaces include a rotating scrapper to remove the solidified form of the second fluid from a drum-shaped cold surface. In some embodiments, the one or more solid removers configured to remove the solidified form of the second fluid from the one or more cold surface include one or more linear scrappers to remove the solidified form of the second fluid from one or more planar cold surfaces.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
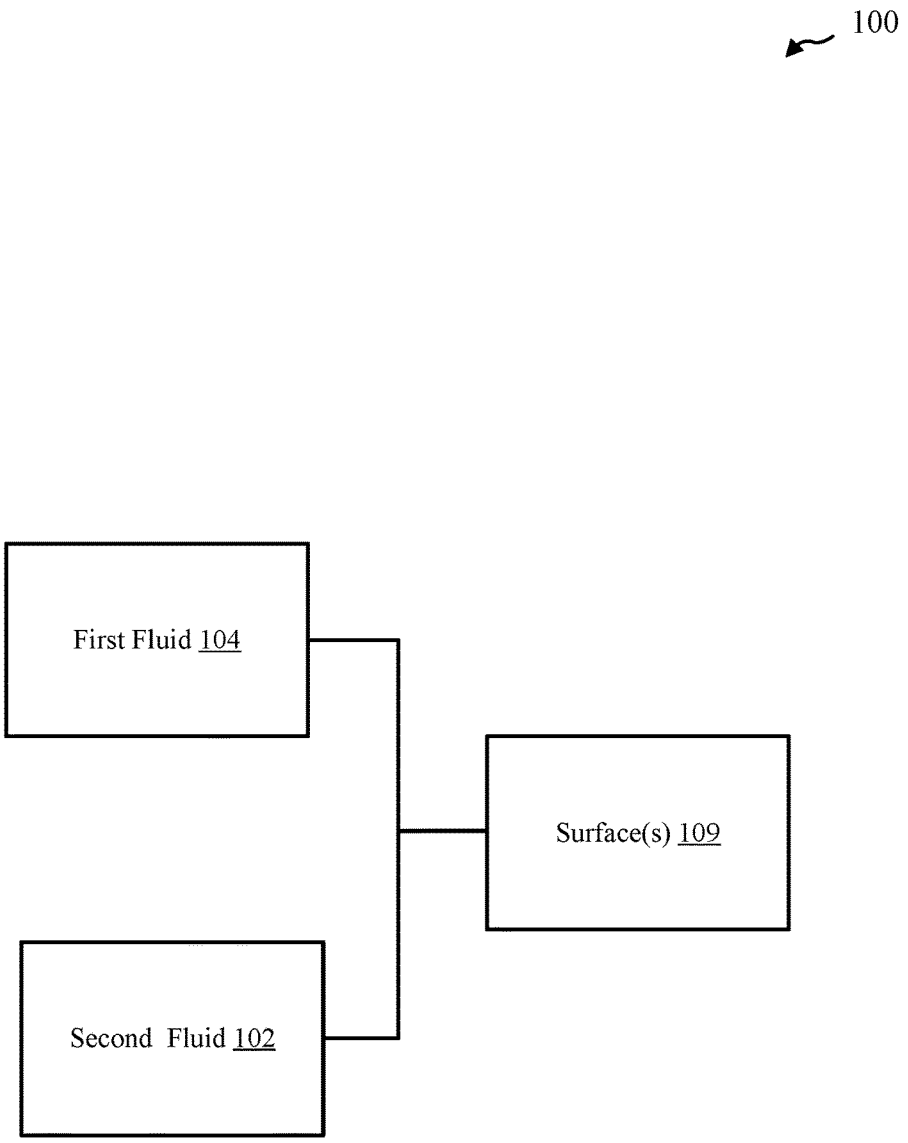
FIG. 1A shows a system in accordance with various embodiments.

This description provides embodiments, and is not intended to limit the scope, applicability or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted, or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Methods, systems, and device for solidification and/or solid production, such as ice production, are provided in accordance with various embodiments. Some embodiments may provide for the creation of a solid with a high volumetric surface area, the amount of surface area per a given volume of material, using a machine and/process that may involve minimal energy consumption, mechanical complexity, and/or heat transfer area.

Some embodiments may include hydraulically forming the solid while simultaneously causing it to solidify via cooling.

In some embodiments, the hydraulic formation is controlled by the introduction of the two materials into a coil where the hydrodynamic properties of the entraining fluid (the first fluid) may cause the solidifying fluid (the second fluid) to automatically form shapes of a predictable size and/or shape. The hydrodynamic properties of the first fluid may be controlled by specific design features of the coil including, for example, its diameter, geometry, interior structure, length, and/or combination of different zones with changing features.

The fluids in various embodiments are generally immiscible, which may allow for them to directly physical and thermal contact throughout the process. In some embodiments, the first fluid is a non-polar material and the second fluid is a polar material. For example, the first fluid may include a hydrocarbon, aromatic, fluorinated, or silicone oil, where an example of the second fluid may include an immiscible polar fluid, such as water, acidic acid, formic acid or other carbocyclic acids, sulfuric acid, ethylene or polyethylene glycol, medium sized alcohols such as tert-butyl, or DMSO. In some embodiments, the first fluid is a polar material and the second fluid is a non-polar material. For example, the first fluid may include water, alcohol, propylene or ethylene glycol, DMSO, ammonia, or nitric acid where the second fluid may include a fluorinated oil, cresol, a high molecular weight silicon oil, a high molecular weight hydrocarbon oil or paraffin, a thermoset polymer, or a metallic alloy.

Some embodiments include a coil assembly and/or various peripheral equipment that may be utilized for the coil to operate. Those peripherals may include, for example, a pump for the first fluid, a mixing nozzle for both fluids, a heat exchanger for cooling the first fluid or the mixture, and/or containers for storing both the mixture, the first fluid, and the second fluid.

Some embodiments may utilize a cold surface that may be protected by a first fluid. A second fluid may be allowed to come in near contact with the cold surface and solidify. The protection from the immiscible fluid may allow for the solid to be removed using a less or minimally complicated and/or low power mechanical device.

The fluids used in various embodiments are generally immiscible, which may allow for them to physically and/or thermally contact each other throughout the process. Additionally, the first fluid may be chosen based on its affinity for the cold surface. If it has a higher affinity for the surface than the second fluid, surface tension effects may overpower buoyancy or mechanical forces and the cold surface may be protected.

In some embodiments, the first fluid may be an oil such as a hydrocarbon oil, an aromatic oil, or a silicone oil. The second fluid may be a polar fluid such as water or DMSO. In some embodiments, if the cold surface is a metal or plastic, the oil may preferentially cover the surface protecting it even under high hydrostatic or mechanical loading from the water, which may allow for high heat transfer between the water and cold surface but leaving the water poorly adhered to the cold surface so it may be removed with low power and mechanical complexity.

Various examples in accordance with various embodiments are provided. Some embodiments may in general show fluid lines and heat exchangers as non-integral from any other pieces of process equipment. One skilled in the art generally knows that this may not always the case and may be depicted here for clarity. Additionally, not all the representations in these figures are illustrative and may not represent the geometric features of the coil; some may provide greater detail.

Turning now to FIG. 1A, a system 100 for solid production is provided in accordance with various embodiments. System 100 may include a first fluid 104 and a second fluid 102; the first fluid 104 and the second fluid 102 may be immiscible with respect to each other. The system 100 may include one or more surfaces 109 configured to contact the first fluid 104 and the second fluid 102 with each other and to form one or more solids from the second fluid 102.

In some embodiments of the system 100, the one or more surfaces 109 are configured such that the first fluid 104 and the second fluid 102 are contacted with each other such that the second fluid 102 is entrained within the first fluid 104. The one or more surfaces 109 may include one or more coils configured to solidify at least a portion of the second fluid 102.

In some embodiments of the system 100, the one or more surfaces 109 include one or more cold surfaces such that the first fluid 104 has an affinity for the one or more cold surfaces. Some embodiments include one or more solid removers configured to remove a solidified form of the second fluid 102 from the one or more cold surfaces.

In some embodiments of the system 100, the first fluid 104 includes a non-polar material and the second fluid 102 includes a polar material. In some embodiments, the first fluid 104 includes at least hydrocarbon oil, aromatic oil, fluorinated oil, or silicone oil. In some embodiments, the second fluid 102 includes at least water, acidic acid, formic acid, carbocyclic acids, sulfuric acid, ethylene glycol, polyethylene glycol, tert-butyl, or DMSO. In some embodiments, the first fluid 104 includes aromatic oil and the second fluid 102 includes water. In some embodiments, the first fluid 104 includes hydrocarbon oil and the second fluid 102 includes water.

In some embodiments of the system 100, the first fluid 104 includes a polar material and the second fluid 102 includes a non-polar material. In some embodiments, the first fluid 104 includes at least water, alcohol, propylene glycol, ethylene glycol, DMSO, ammonia, or nitric acid. In some embodiments, the second fluid 102 includes at least fluorinated oil, cresol, high molecular weight silicon oil, high molecular weight hydrocarbon oil, high molecular weight paraffin, thermoset polymer, or metallic alloy. In some embodiments, the first fluid 104 includes water and the second fluid 102 includes at least high-molecular weight paraffin or thermoset polymer.

Some embodiments of the system 100 include a heat exchanger positioned to cool the first fluid 104 before entraining the second fluid 102 within the first fluid 104. In some embodiments, the first fluid 104 and the second fluid 102 are cooled simultaneously within the one or more coils. In some embodiments of the system 100, one or more hydrodynamic properties of the first fluid 104 within the one or more coils form the second fluid 102 into one or more solidified shapes. In some embodiments of the system 100, the one or more solidified shapes are formed with at least a predictable size or a predictable shape. In some embodiments, one or more features of the coil control the one or more hydrodynamic properties of the first fluid 104 that form the second fluid 102 into the one or more solidified shapes formed with at least the predictable size or the predictable shape. In some embodiments, the one or more features of the coil include at least one or more diameters of the coil, one or more geometries of the coil, one or more interior structures of the coil, one or more orientations of the coil, or one or more lengths of the coil. In some embodiments, the one or more features of the coil include a change in orientation of the coil. In some embodiments, the one or more features of the coil include a change in diameter of the coil.

Some embodiments of the system 100 include a mixing nozzle configured to entrain the second fluid 102 within the first fluid 104. Some embodiments include a tube positioned within the mixing nozzle such that the second fluid 102 is introduced as a parallel flow to the first fluid 104. Some embodiments include a tube positioned within the mixing nozzle such that the second fluid 102 is introduced as a perpendicular flow to the first fluid 104.

In some embodiments of the system 100, the first fluid 104 coats at least a portion of the one or more cold surfaces and interferes with the second fluid 102 from adhering to the one or more cold surfaces. Some embodiments include a first storage container configured to hold the first fluid 104 and a second storage container configured to hold the second fluid 102. Some embodiments include a combiner configured to combine the first fluid 104 from the first storage container with the second fluid 102 from the second storage container for delivery to the one or more cold surfaces; the combiner may be an example of a mixing nozzle. Some embodiments include a first conduit coupled with the first storage container and a second conduit coupled with the second storage container; the first conduit and the second conduit may be configured to deliver the first fluid 104 and the second fluid 102 separately to the one or more cold surfaces. In some embodiments, the first conduit is coupled with the one or more solid removers to facilitate delivery of the first fluid 104 to the one or more cold surfaces.

In some embodiments of the system 100, the one or more cold surfaces are comprised of a metal. Some embodiments may include other materials such as plastic, ceramic, and/or glass for the one or more cold surfaces.

In some embodiments of the system 100, the one or more solid removers configured to remove the solidified form of the second fluid 102 from the one or more cold surfaces include an auger to remove the solidified form of the second fluid 102 from a cylindrically-shaped cold surface. In some embodiments, the one or more solid removers configured to remove the solidified form of the second fluid 102 from the one or more cold surfaces include a rotating scrapper to remove the solidified form of the second fluid 102 from a drum-shaped cold surface. In some embodiments, the one or more solid removers configured to remove the solidified form of the second fluid 102 from the one or more cold surface include one or more linear scrappers to remove the solidified form of the second fluid 102 from one or more planar cold surfaces.

Figure 1B:
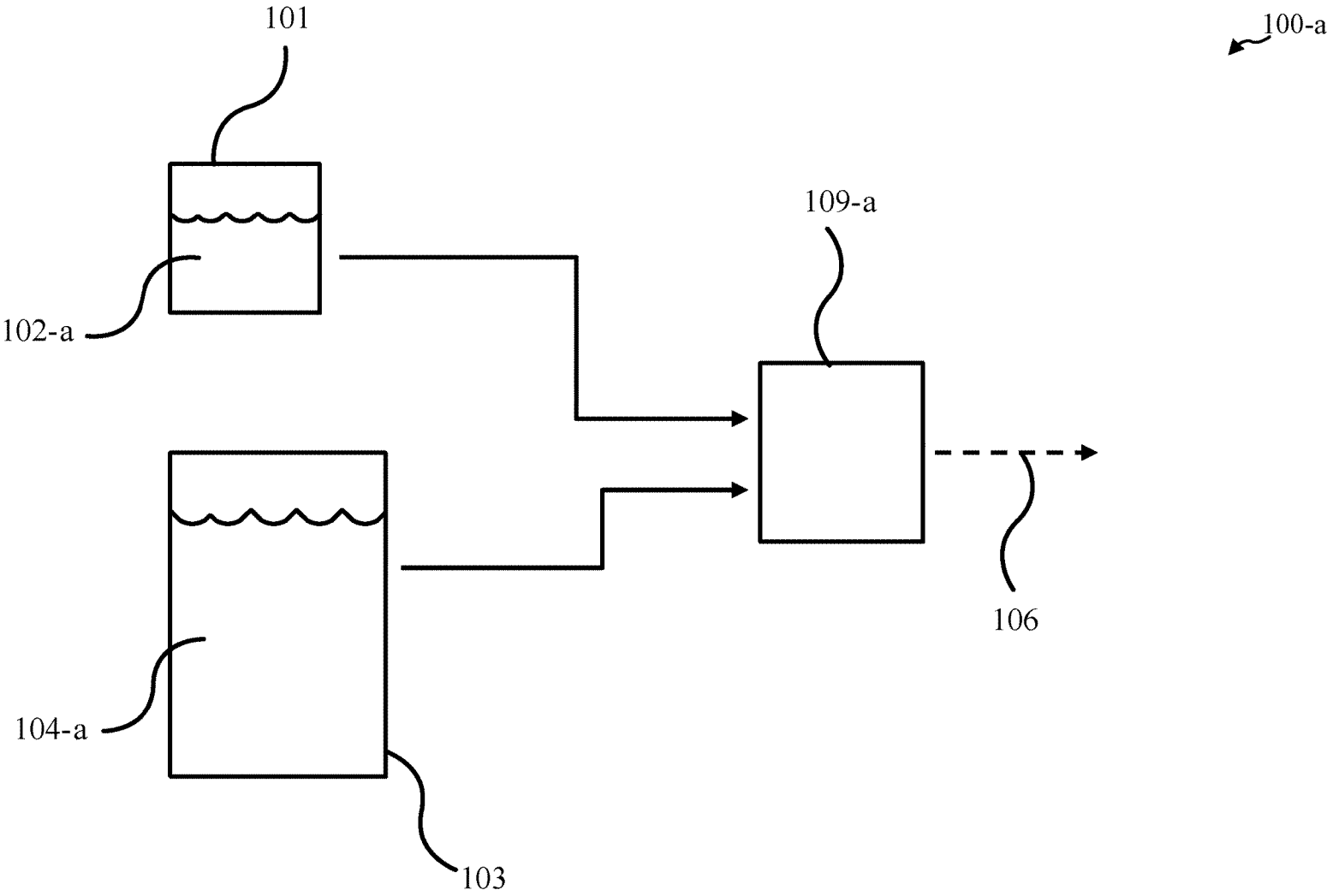
FIG. 1B shows a system in accordance with various embodiments.

Turning now to FIG. 1B, a system 100-*a* for solid production is provided in accordance with various embodiments. System 100-*a* may be an example of system 100 of FIG. 1A. System 100-*a* may include a first fluid 104-*a* and a second fluid 102-*a*; the first fluid 104-*a* and the second fluid 102-*a* may be immiscible with respect to each other. The system 100-*a* may include one or more surfaces 109-*a* configured to contact the first fluid 104-*a* and the second fluid 102-*a* with each other and to form one or more solids from the second fluid 102-*a*. For example, the one or more surfaces 109-*a* may be configured such that the first fluid 104-*a* and the second fluid 102-*a* are contacted with each other such that the second fluid 102-*a* is entrained within the first fluid 104-*a*. The one or more surfaces 109-*a* may include one or more coils configured to solidify at least a portion of the second fluid 102-*a*. In some embodiments, the first fluid 104-*a* may be stored in a first fluid storage container 103 before being delivered to the one or more surfaces 109-*a*; similarly, the second fluid 102-*a* may be stored in a second fluid storage container 101 before being delivered to the one or more cold surfaces 109-*a*.

In some embodiments, the first fluid 104-*a* may be extracted from the first fluid storage container 103 and may be sent to the one or more surfaces 109-*a* that may be configured as an entraining or mixing assembly, which may be an example of the one or more surfaces 109 of FIG. 1A. The second fluid 102-*a* may be taken from the second fluid storage container 101 and may be sent to the entraining or mixing assembly 109-*a*; this may happen simultaneously with the extraction of the first fluid 104-*a* from the first fluid storage container 103. In the entraining or mixing assembly 109-*a*, the fluids 104-*a* and 102-*a* may be entrained or mixed and cooled in a way that may produce a solid with a predictable size, such as high surface area, and/or predictable shape. The result may be an entrained or mixed flow 106 with both the first fluid 104-*a* and the second fluid 102-*a*, where the second fluid 102-*a* may have been converted to a solid and may be carried by the first fluid 104-*a*.

Some embodiments of the system 100-*a* include a heat exchanger positioned to cooling the first fluid 104-*a* before entraining the second fluid 102-*a* within the first fluid 104-*a*. In some embodiments, the first fluid 104-*a* and the second fluid 102-*a* are cooled simultaneously within the one or more coils. In some embodiments of the system 100-*a*, one or more hydrodynamic properties of the first fluid 104-*a* within the one or more coils form the second fluid 102-*a* into one or more solidified shapes. In some embodiments of the system 100-*a*, the one or more solidified shapes are formed with at least a predictable size or a predictable shape. In some embodiments, one or more features of the coil control the one or more hydrodynamic properties of the first fluid 104-*a* that form the second fluid 102-*a* into the one or more solidified shapes formed with at least the predictable size or the predictable shape. In some embodiments, the one or more features of the coil include at least one or more diameters of the coil, one or more geometries of the coil, one or more interior structures of the coil, one or more orientations of the coil, or one or more lengths of the coil. In some embodiments, the one or more features of the coil include a change in orientation of the coil. In some embodiments, the one or more features of the coil include a change in diameter of the coil.

Some embodiments of the system 100-*a* include a mixing nozzle configured to entrain the second fluid 102-*a* within the first fluid 104-*a*. Some embodiments include a tube positioned within the mixing nozzle such that the second fluid 102-*a* is introduced as a parallel flow to the first fluid 104-*a*. Some embodiments include a tube positioned within the mixing nozzle such that the second fluid 102-*a* is introduced as a perpendicular flow to the first fluid 104-*a*.

Figure 1C:
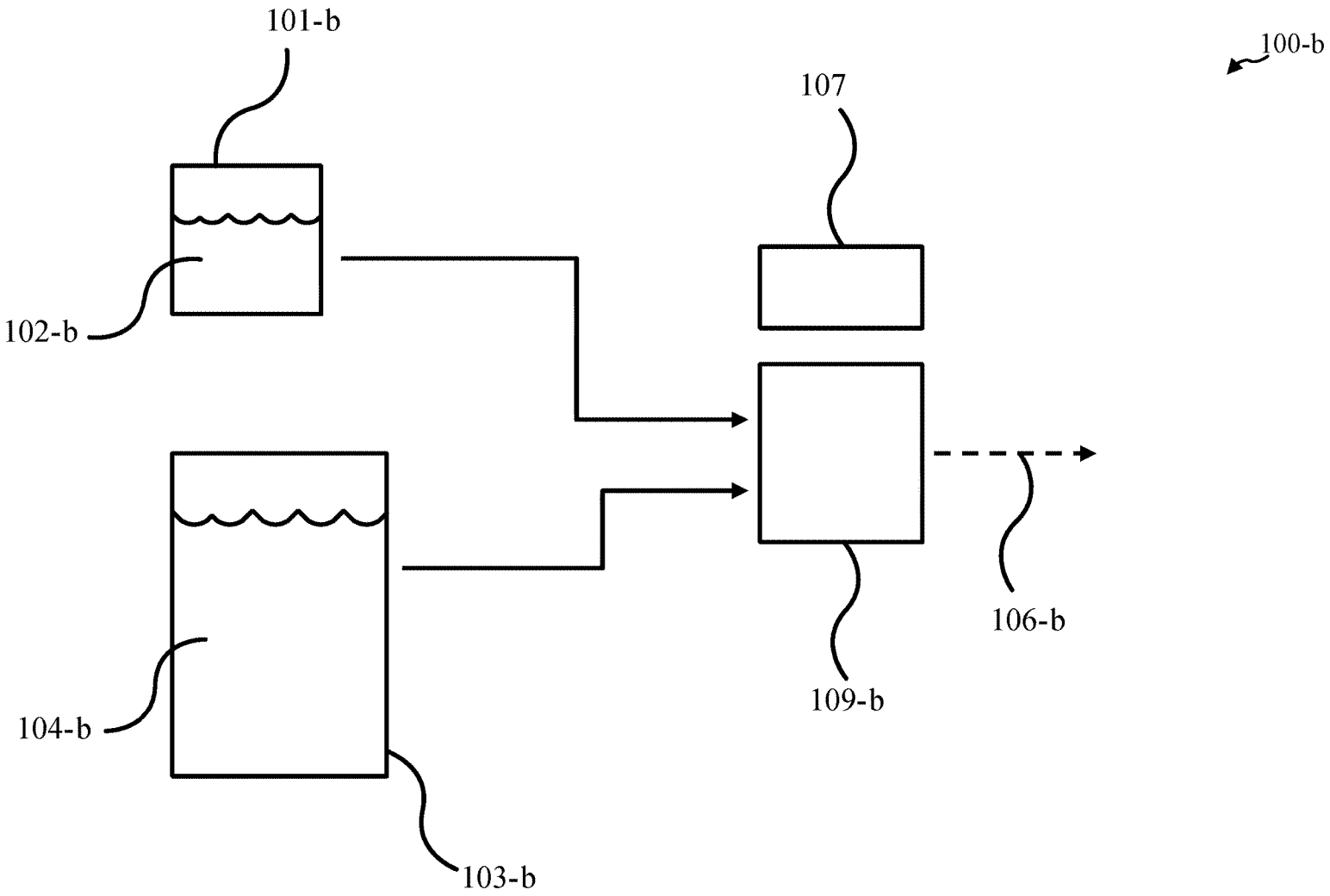
FIG. 1C shows a system in accordance with various embodiments.

Turning now to FIG. 1C, a system 100-*b* for solid production is provided in accordance with various embodiments. System 100-*b* may be an example of system 100 of FIG. 1A. System 100-*b* may include a first fluid 104-*b* and a second fluid 102-*b*; the first fluid 104-*b* and the second fluid 102-*b* may be immiscible with respect to each other. The system 100-*b* may include one or more surfaces 109-*b* configured to contact the first fluid 104-*b* and the second fluid 102-*b* with each other and to form one or more solids from the second fluid 102-*b*. In some embodiments, the first fluid 104-*b* may be stored in a first fluid storage container 103-*b* before being delivered to the one or more surfaces 109-*b*; similarly, the second fluid 102-*b* may be stored in a second fluid storage container 101-*b* before being delivered to the one or more cold surfaces 109-*b*.

The one or more surfaces 109-*b* may include one or more cold surfaces such that the first fluid 104-*b* has an affinity for the one or more cold surfaces. For example, the one or more cold surfaces may include a metal while the first fluid may include an oil. In an example case where the second fluid is water, the first fluid's surface energy-based affinity for the metallic cold surface may cause the first fluid to preferentially coat the cold surface. System 100-*b* may include one or more solid removers 107 configured to remove a solidified form of the second fluid 102-*b* from the one or more cold surfaces.

In some embodiments of the system 100-*b*, the first fluid 104-*b* coats at least a portion of the one or more cold surfaces and interferes with the second fluid 102-*b* from adhering to the one or more cold surfaces. Some embodiments include a combiner configured to combine the first fluid 104-*b* from the first storage container 103-*b* with the second fluid 102-*b* from the second storage container 101-*b* for delivery to the one or more cold surfaces. Some embodiments include a first conduit coupled with the first storage container 103-*b* and a second conduit coupled with the second storage container 101-*b*; the first conduit and the second conduit may be configured to deliver the first fluid 104-*b* and the second fluid 102-*b* separately to the one or more cold surfaces. In some embodiments, the first conduit is coupled with the one or more solid removers 107 to facilitate delivery of the first fluid 104-*b* to the one or more cold surfaces.

In some embodiments of the system 100-*b*, the one or more solid removers 107 configured to remove the solidified form of the second fluid 102-*b* from the one or more cold surfaces include an auger to remove the solidified form of the second fluid 102-*b* from a cylindrically-shaped cold surface. In some embodiments, the one or more solid removers 107 configured to remove the solidified form of the second fluid 102-*b* from the one or more cold surfaces include a rotating scrapper to remove the solidified form of the second fluid 102-*b* from a drum-shaped cold surface. In some embodiments, the one or more solid removers 107 configured to remove the solidified form of the second fluid 102-*b* from the one or more cold surface include one or more linear scrappers to remove the solidified form of the second fluid 102-*b* from one or more planar cold surfaces.

Figure 2A:
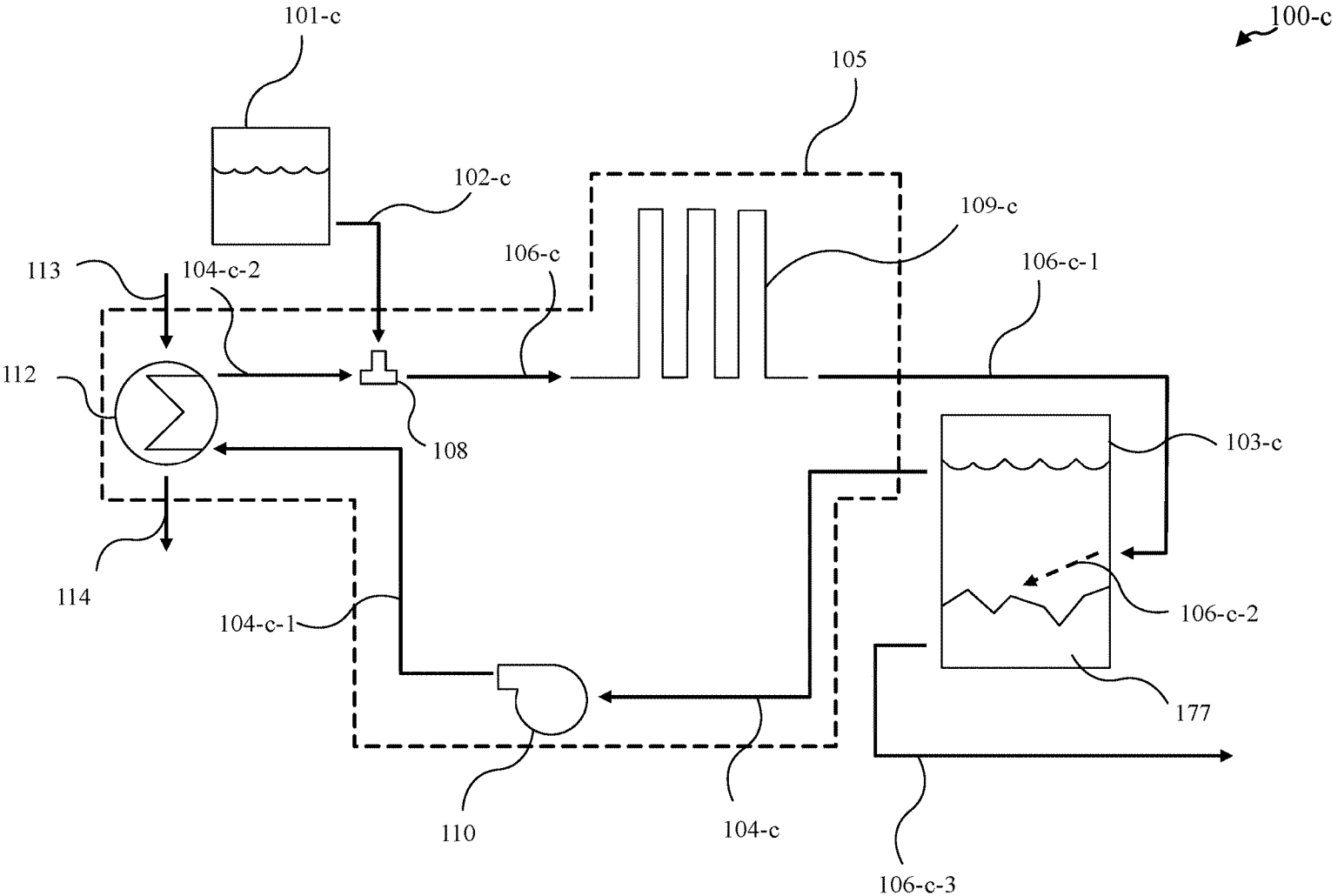
FIG. 2A shows a system in accordance with various embodiments.

FIG. 2A shows a system 100-*c* in accordance with various embodiments where the cooling of a first fluid 104-*c* may take place before the mixing of the two fluids, including a second fluid 102-*c*, and formation of a solid. System 100-*c* may be an example of system 100 of FIG. 1A and/or system 100-*a* of FIG. 1B. In this embodiment, the process may take place inside a mixing assembly 105. In this embodiment, the first fluid 104-*c* may leave a storage container 103-*c* and may enter a pump 110. A pumped first fluid 104-*c*-1 may then move to a heat exchanger 112 where it may be cooled, producing a chilled first fluid 104-*c*-2. The heat exchanger 112 may be cooled by a refrigerant 113-114. The first fluid 104-*c*-2 may then flow to a mixing nozzle 108 where the second fluid 102-*c* may be injected into the flow to form a mixed all-liquid flow 106-*c*. The first fluid 104-*c*-2 and the second fluid 102-*c* may be immiscible with respect to each other; the second fluid 102-*c* may be entrained within the first fluid 104-*c*-2. This mixture 106-*c* then may enter a coil 109-*c* where it may be hydrodynamically formed into a predictable shape and/or size. Inside the coil 109-*c*, the cold first fluid 104-*c*-2 may be warmed by the warmer second fluid 102-*c* and the heat that may be removed from the second fluid 102-*c* may cause it to solidify while it may be being hydrodynamically shaped. This mixture 106-*c*-1 may leave the coil 109-*c* with the second fluid 102-*c* solidified to the desired degree and may enter the first fluid storage container 103-*c* where the hydrodynamics change due to changing geometry and the solidified second fluid 106-*c*-2 may be separated into a packed bed 177. The solid may then be removed 106-*c*-3 as a mixture of highly concentrated solidified second fluid.

Figure 2B:
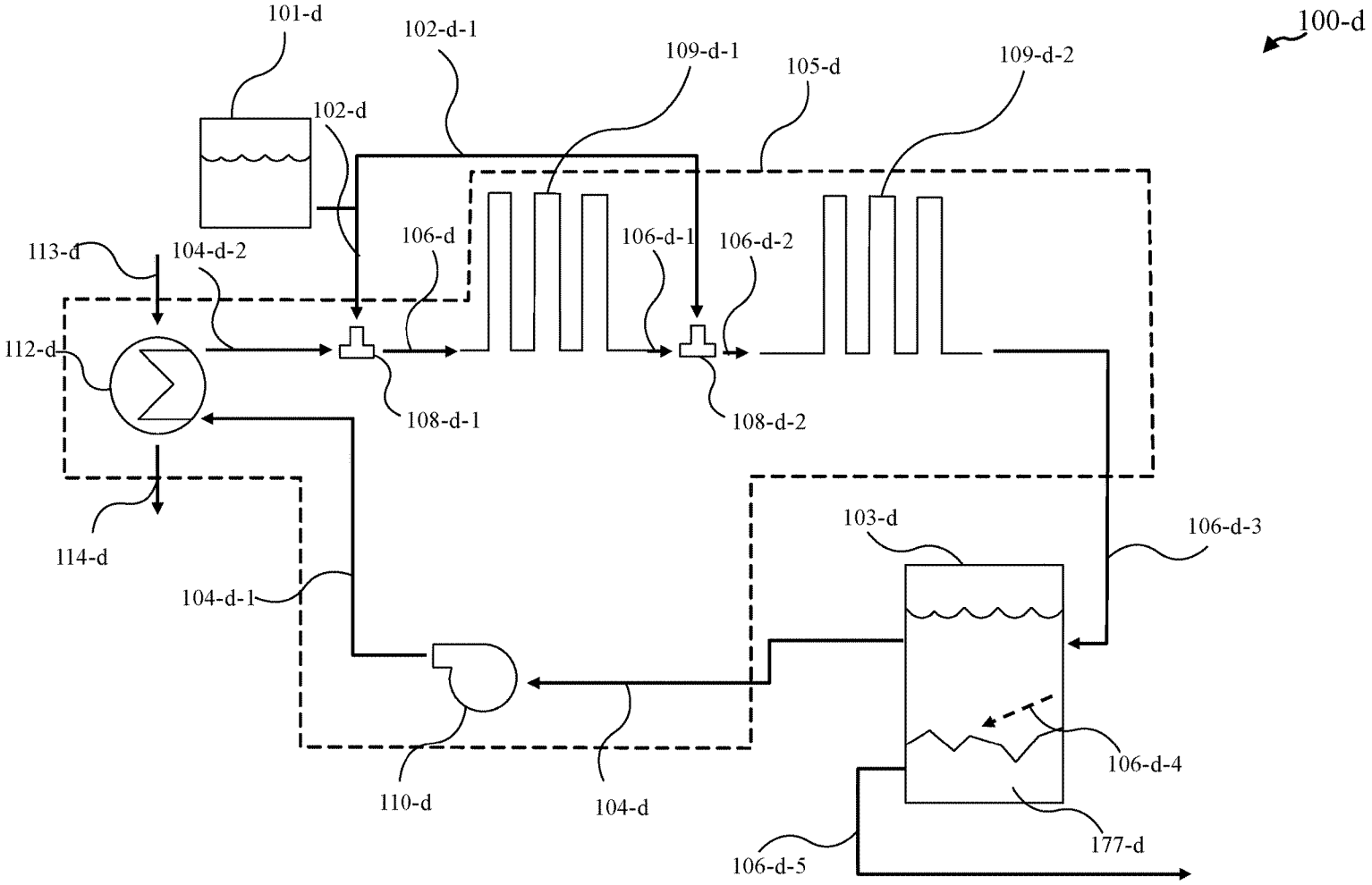
FIG. 2B shows a system in accordance with various embodiments.

FIG. 2B shows a system 100-*d* in accordance with various embodiments. System 100-*d* may be an example of system 100 of FIG. 1A, system 100-*a* of FIG. 1B, and/or system 100-*c* of FIG. 2A. System 100-*d* may provide an embodiment in which the cooling of a first fluid 104-*d* may take place before the mixing of the two fluids, including a second fluid 102-*d*, and formation of a solid. This process may take place inside a mixing assembly 105-*d*. In this embodiment, the first fluid 104-*d* may leave the storage container 103-*d* and may enter a pump 110-*d*. The pumped first fluid 104-*d*-1 may then move to the heat exchanger 112-*d* where it may be cooled, producing a chilled first fluid 104-*d*-2. The heat exchanger 112-*d* may be cooled by a refrigerant 113-*d*/114-*d*. The first fluid 104-*d*-2 then may flow to a mixing nozzle 108-*d*-1 where the second fluid 102-*d* may be injected into the flow to form a mixed all-liquid flow 106-*d*. The first fluid 104-*d*-2 and the second fluid 102-*d* may be immiscible with respect to each other; the second fluid 102-*d* may be entrained within the first fluid 104-*d*-2. This mixture 106-*d* then may enter a coil 109-*d*-1 where it may be hydrodynamically formed into a predictable shape and/or size. Inside the coil 109-*d*-1, the cold first fluid 104-*d*-2 may be warmed by the warmer second fluid 102-*d* and the heat that may be removed from the second fluid 102-*d*, which may cause it to partially solidify while it may be being hydrodynamically shaped. The mixture 106-*d*-1 may leave the coil 109-*d*-1 and may enter another injection nozzle 108-*d*-2 where more second fluid 102-*d*-1 may be added before the mixture 106-*d*-2 may enter a second coil 109-*d*-2. Inside coil 109-*d*-2, the second fluid 102-*d* may continue to solidify. This mixture 106-*d*-3 may leave the coil 109-*d*-2 with the second fluid 102-*d* solidified to the desired degree and may enter the first fluid storage container 103-*d* where the hydrodynamics change due to changing geometry and the solidified second fluid 106-*d*-4 may be separated into the packed bed 177-*d*. The solid may then be removed 106-*d*-5 as a mixture of highly concentrated solidified second fluid.

Figure 3:
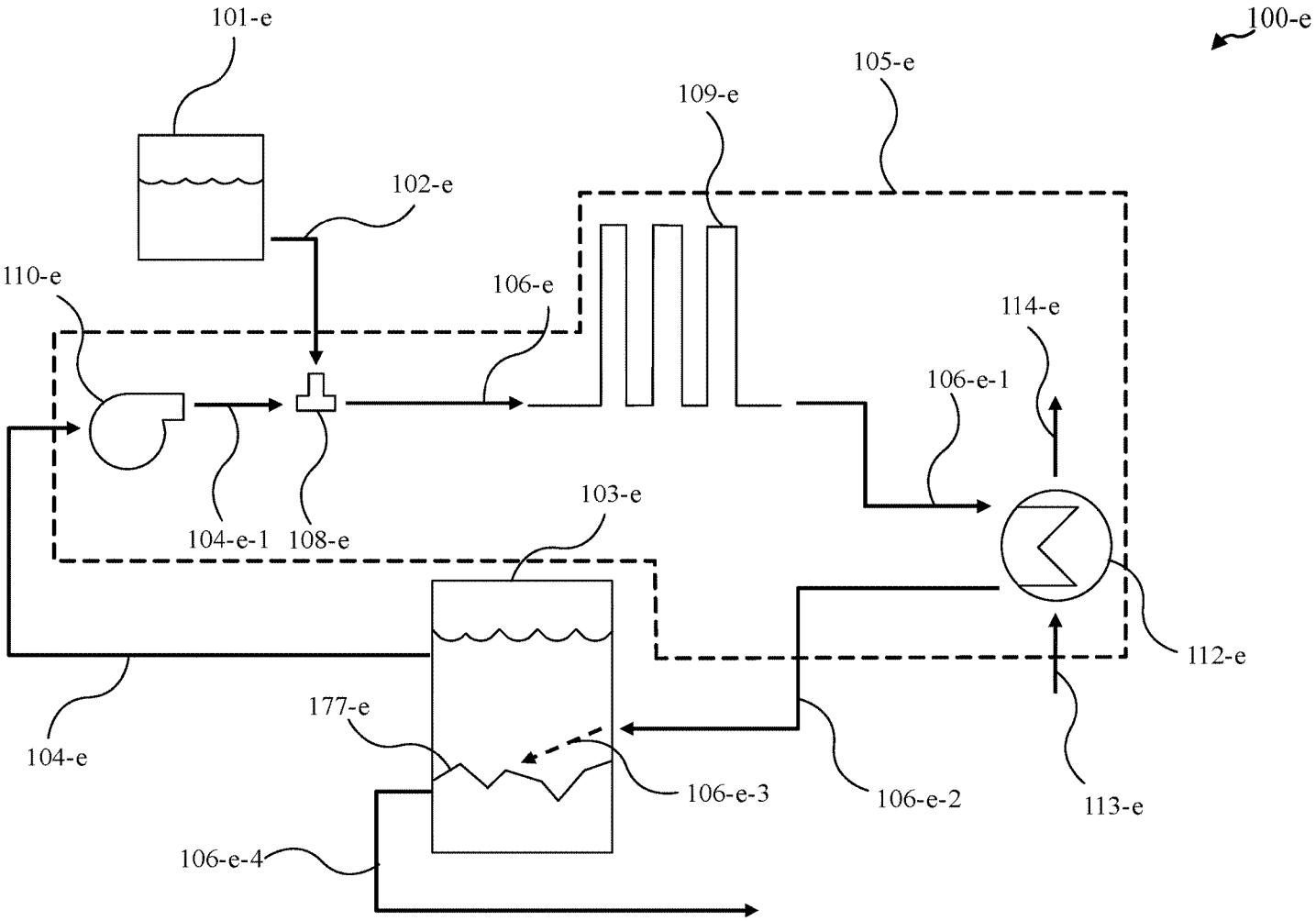
FIG. 3 shows a system in accordance with various embodiments.

FIG. 3 shows a system 100-*e* for solid production in accordance with various embodiments. System 100-*e* may be an example of system 100 of FIG. 1A and/or system 100-*a* of FIG. 1B. System 100-*e* may provide an embodiment in which the cooling of a first fluid 104-*e* may take place after the mixing of the two fluids, including a second fluid 102-*e*, and in the process of the formation of the solid. This process may take place inside a mixing assembly 105-*e*. In this embodiment, the first fluid 104-*e* may leave a storage container 103-*e* and enters a pump 110-*e*. The pumped first fluid 104-*e*-1 may then move to a mixing nozzle 108-*e* where the second fluid 102-*e* may be injected into the flow to form a mixed all-liquid flow 106-*e*. The first fluid 104-*e*-1 and the second fluid 102-*e* may be immiscible with respect to each other; the second fluid 102-*e* may be entrained within the first fluid 104-*e*-1. This mixture 106-*e* then may enter a coil 109-*e* where it may be hydrodynamically formed into a predictable shape and/or size. Inside the coil 109-*e*, the cold first fluid 104-*e*-1 may be warmed by the warmer second fluid 102-*e* and the heat that may be removed from the second fluid 102-*e*, which may cause it to partially solidify while it may be being hydrodynamically shaped. This mixture 106-*e*-1 may leave the coil 109-*e* with the second fluid 102-*e* partially solidified and may enter the heat exchanger 112-*e* where the partially solidified particles may be solidified, completely in some cases, by the cooling effect of the heat exchanger 112-*e*. The heat exchanger 112-*e* may be cooled by a refrigerant 113-*e*/114-*e*. The mixture with solidified second fluid 106-*e*-2, which may be completely solidified in some cases, may then enter the first fluid storage container 103-*e* where the hydrodynamics change due to changing geometry and the solidified second fluid 106-*e*-3 may be separated into a packed bed 177-*e*. The solid may then be removed 106-*e*-4 as a mixture of highly concentrated solidified second fluid.

Figure 4:
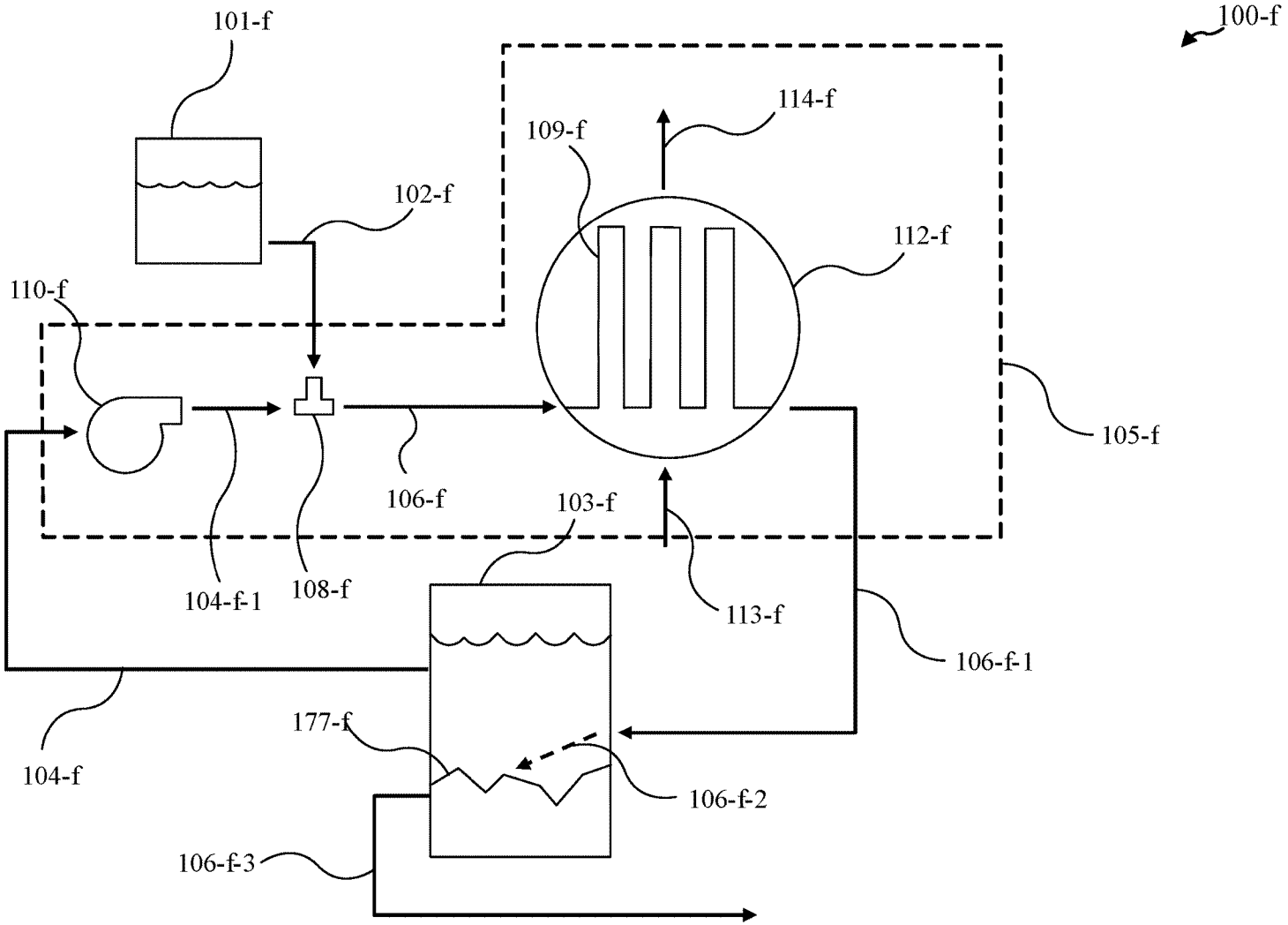
FIG. 4 shows a system in accordance with various embodiments.

FIG. 4 shows a system 100-*f* for solid production in accordance with various embodiments. System 100-*f* may be an example of system 100 of FIG. 1A and/or system 100-*a* of FIG. 1B. System 100-*f* may provide an in which the cooling of a first fluid 104-*f* takes place simultaneously with the mixing of two fluids, including a second fluid 102-*f*, and the process of solid formation. This process may take place inside a mixing assembly 105-*f*. In this embodiment, the first fluid 104-*f* may leave a storage container 103-*f* and may enter a pump 110-*f*. The pumped first fluid 104-*f*-1 may then move to a mixing nozzle 108-*f* where the second fluid 102-*f* may be injected into the flow to form a mixed all-liquid flow 106-*f*. The first fluid 104-*f*-1 and the second fluid 102-*f* may be immiscible with respect to each other; the second fluid 102-*f* may be entrained within the first fluid 104-*f*-1. This mixture 106-*f* then may enter a coil 109-*f* where it may be hydrodynamically formed into a predictable shape and/or size. Inside the coil 109-*f*, the cold first fluid 104-*f*-1 may be warmed by the warmer second fluid 102-*f* and the heat that may be removed from the second fluid 102-*f*, which may cause it to partially solidify while it may be being hydrodynamically shaped. Simultaneous to this inter-fluid heat transfer, the mixture 106-*f* may be itself cooled by the chilling of the coil's walls via the presence of a refrigerant 113-*f*/114-*f* on the outside of the coil walls. This cooling may be present because the coil 109-*f* may be integral to a heat exchanger 112-*f*. While inside the coil 109-*f*, the second fluid 102-*f* may be solidified, completely in some cases. This mixture 106-*f*-1 may leave the coil 109-*f* with the second fluid 102-*f* solidified, completely in some cases, and may enter the first fluid storage container 103-*f* where the hydrodynamics change due to changing geometry and the solidified second fluid 106-*f*-2 may be separated into the packed bed 177-*f*. The solid may then be removed 106-*f*-3 as a mixture of highly concentrated solidified second fluid.

Figure 5:
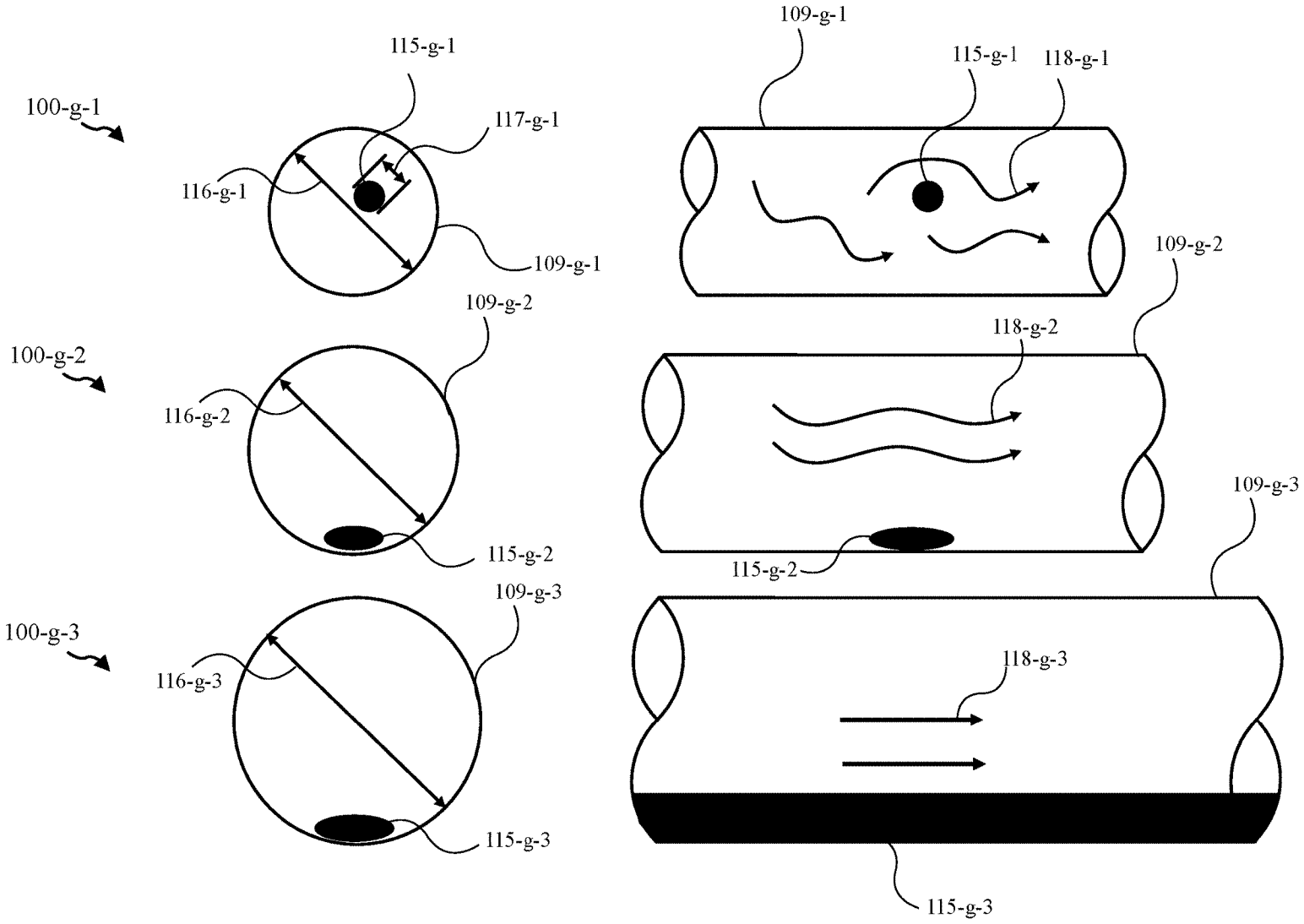
FIG. 5 show systems in accordance with various embodiments.

Turning now to FIG. 5, cross-sectional and side views of aspects of systems 100-*g*-1, 100-*g*-2, and 100-*g*-3 are provided in accordance with various embodiments. These embodiments may highlight the hydrodynamics of a fully developed flow inside coils 109-*g*-1, 109-*g*-2, and 109-*g*-3, respectively. Coils 109-*g*-1, 109-*g*-2, and/or 109-*g*-3 may be examples of surfaces and/or coils 109 of FIG. 1A, FIG. 1B, FIG. 2A, FIG. 2B, FIG. 3, and/or FIG. 4. Additionally, the FIG. 5 may illustrate one way that the hydrodynamics may control the formation of predictably shaped and/or sized solid formed from a second fluid entrained within a first fluid. The second fluid may be an example of the second fluid 102 of FIG. 1A or FIG. 1B, for example; the first fluid may be an example of the first fluid 104 of FIG. 1A or FIG. 1B, for example. In FIG. 5, it may be shown generally how the diameter 116-*g* of the coil 109-*g* may produce a different hydrodynamic state, which may determine the solid particle size. In the first system 100-*g*-1, the coil 109-*g*-1 with a given diameter 116-*g*-1 may produce a highly turbulent flow 118-*g*-1. In this case, the solid may naturally form a spherical-like particle 115-*g*-1 from a second fluid that may be born aloft and entrained by the flow of a first fluid. The diameter of this particle 117-*g*-1 may be controllable by not only the coil diameter 116-*g*-1, but the flow conditions, relative velocities between the fluids, properties of the two fluids, loading ratio of the two fluids, and/or other hydrodynamic forces. In the system 100-*g*-2, the diameter 116-*g*-2 or the flow conditions 118-*g*-2 within a coil 109-*g*-2 may be changed such that the flow become less turbulent 118-*g*-2 and a solid particle shape that may be larger, flatter, and/or more elliptical 115-*g*-2 may be produced from a second fluid entrained within a first fluid. In the system 100-*g*-2, the diameter 116-*g*-3 and flow conditions 118-*g*-3 may be changed yet again to produce a fully laminar flow of the first fluid 118-*g*-3 and a stratified flow of the two fluids 115-*g*-3, which producing sheets of solidified form of a second fluid. FIG. 5 may be exemplary only. It gives an example of how a coil's geometry (i.e., diameter in this case) may be modified to change the shape and/or size of solid produced.

Figure 6:
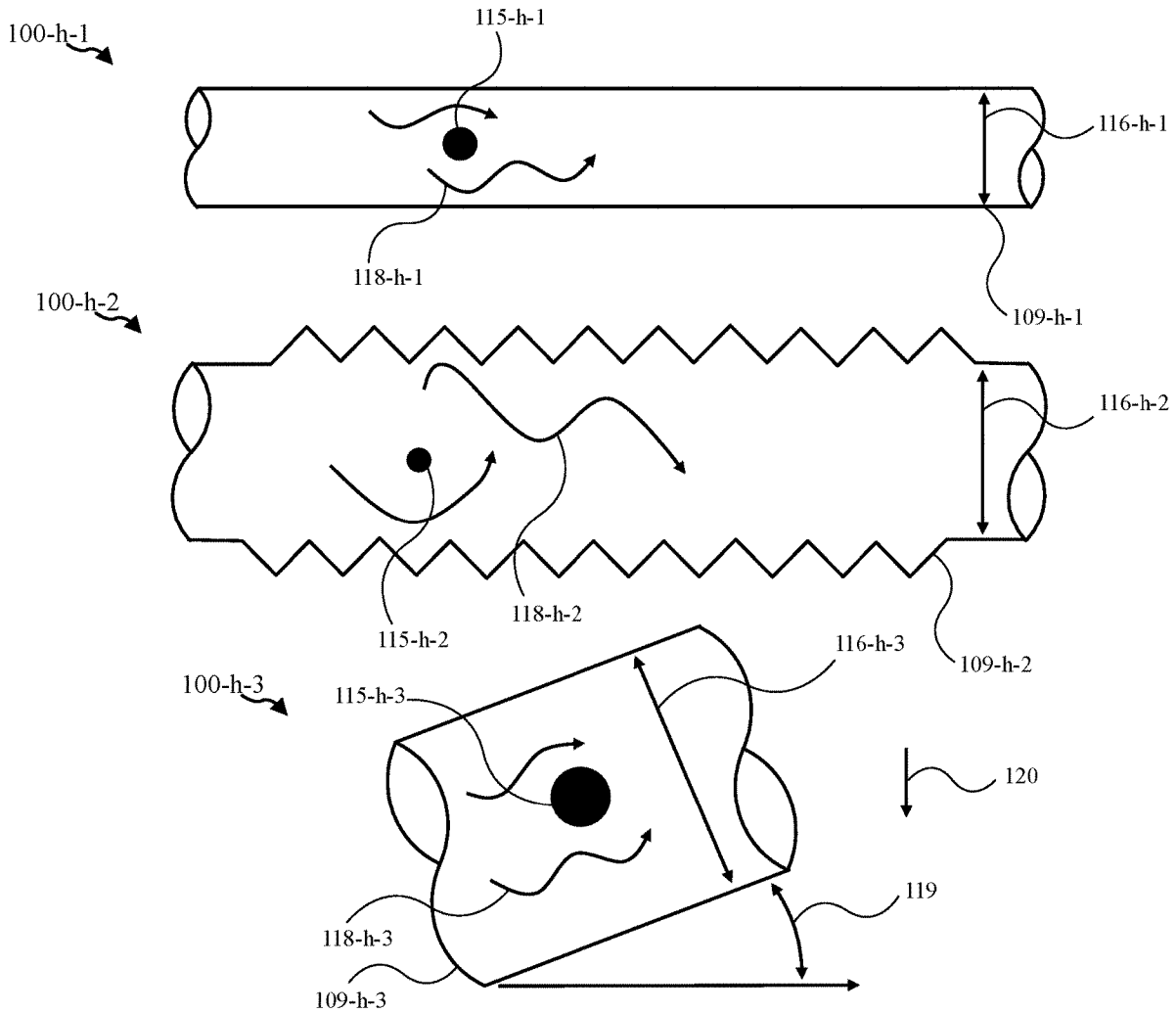
FIG. 6 show systems in accordance with various embodiments.

FIG. 6 provides aspects of systems 100-*h*-1, 100-*h*-2, and 100-*h*-2 that may illustrate the hydrodynamics of the fully developed flow inside coils 109-*h*-1, 109-*h*-2, and 109-*h*-3, respectively. Coils 109-*h*-1, 109-*h*-2, and/or 109-*h*-3 may be examples of surfaces and/or coils 109 of FIG. 1A, FIG. 1B, FIG. 2A, FIG. 2B, FIG. 3, FIG. 4, and/or FIG. 5. FIG. 6 may illustrate one way that the hydrodynamics can control the formation of predictably shaped and sized solid formed from a second fluid entrained within a first fluid. The second fluid may be an example of the second fluid 102 of FIG. 1A or FIG. 1B, for example; the first fluid may be an example of the first fluid 104 of FIG. 1A or FIG. 1B, for example. In FIG. 6, it may be shown how the geometry of the coils 109-*h*-1, 109-*h*-2, and/or 109-*h*-3 can produce a different hydrodynamic state, which may determine the solid particle properties. In the system 100-*h*-1, a smooth tube 109-*h*-1 may be used to produce a spherical ball of solid 115-*h*-1. The diameter 116-*h*-1 of this tube 109-*h*-1 may be set such that the flow rate may produce a turbulent flow 118-*h*-1 capable of carrying the solid 115-*h*-1 in the flow as in the system 100-*g*-1 of FIG. 5. In the system 100-*h*-2, the surface geometry of the tube 109-*h*-2 may be modified to increase the turbulence and allow for the hydrodynamic state to be modified. In this case, the geometry may allow for a change in coil diameter 116-*h*-2 while maintaining the turbulence 118-*h*-2 that may be involved to keep the solid 115-*h*-2 suspended in the flow. This may further allow for the solid 115-*h*-2 to change in shape and/or size at the same flow rate as a smooth coil. The surface geometry may include ribs, riffling, divots, corrugation, and/or any other surface geometry that may affect the turbulence of the second fluid. The system 100-*h*-3 may show a coil 109-*h*-3 at a non-horizontal angle 119. This change may affect the relative gravitational acceleration 120 between the second fluid and the first fluid and again may allow for the shape and size of the first fluid to be modified at a given coil diameter 116-*h*-3. In this case, a less turbulent flow 118-*h*-3 may still produce sufficient lift on the solid particle 115-*h*-3 to keep it entrained in the fluid and spherical in shape. However, in this condition, a much larger solid particle 115-*h*-3 may be achievable at the same tube diameter 116-*h*-3 and flow rate as either of the other examples. FIG. 6 is exemplary only. It gives examples of how the coils geometry (i.e., surface features and tils in this case) may be modified to change the shape and size of solid produced.

Figure 7:
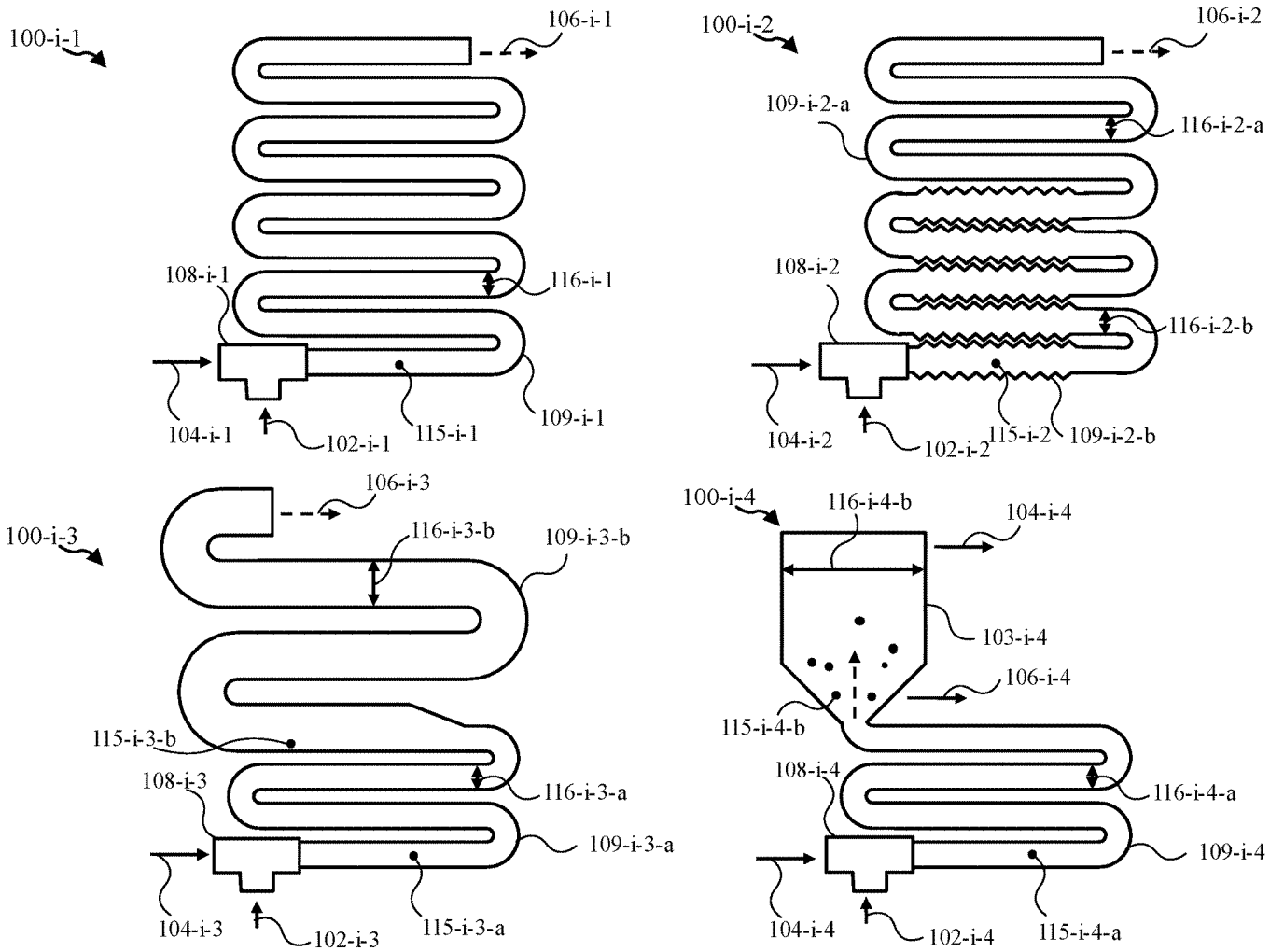
FIG. 7 shows systems in accordance with various embodiments.

FIG. 7 shows aspects of systems 100-*i*-1, 100-*i*-2, 100-*i*-3, and 100-*i*-4 in accordance with various embodiments that may show how a coil 109 may not necessarily be a simple homogeneous device. Instead, it may take advantage of multiple geometric aspects to produce various different effects, which may optimally solidify a second fluid entrained within a first fluid. The second fluid may be an example of the second fluid 102 of FIG. 1A or FIG. 1B, for example; the first fluid may be an example of the first fluid 104 of FIG. 1A or FIG. 1B, for example. Systems 100-*i*-1, 100-*i*-2, 100-*i*-3, and 100-*i*-4 may be examples of aspects of system 100 of FIG. 1A, system 100-*a* of FIG. 1B, system 100-*c* of FIG. 2A, system 100-*d* of FIG. 2B, system 100-*e* of FIG. 3, and/or system 100-*f* of FIG. 4. In system 100-*i*-1, a simple homogeneous coil 109-*i*-1 with a constant diameter 116-*i*-1 may be shown. The first fluid 104-*i*-1 and the second fluid 102-*i*-1 may be mixed in the mixing nozzle 108-*i*-1 and then may enter the coil 109-*i*-1. The flow in the coil 109-*i*-1 may be such that the hydrodynamics automatically create solidifying second fluid 115-*i*-1 of a certain size and/or shape. At the outlet of the coil 109-*i*-1, this mixture 106-*i*-1 may exit as a combined flow. In system 100-*i*-2, the coil may include two zones 109-*i*-2-*a*,109-*i*-2-*b* in order to achieve a different solidification outcome. The first fluid 104-*i*-2 and the second fluid 102-*i*-2 may be mixed in the mixing nozzle 108-*i*-2 and then may enter the coil. The first section of the coil 109-*i*-2-*b* may have a specific diameter 116-*i*-2-*b* and surface feature that may allow for the solid particle size or shape to be adjusted. For example, it may have a larger diameter at the same flow rate of first fluid. This zone may allow for this larger solid particle to be formed 115-*i*-2 and partially solidified. The solid then may flow into the second zone 109-*i*-2-*a* where it may flow through a smooth surface coil and may solidify to the desired outlet condition. In this way, a desired solid particle size may be produced in one section of coil and then may be solidified to a desired amount in a separate section with different flow conditions. The mixture 106-*i*-2 may then exit the coil. In system 100-*i*-3, the coil may be shown with two different diameters. The first fluid 104-*i*-3 and the second fluid 102-*i*-3 may be mixed in the mixing nozzle 108-*i*-3 and then may enter the coil. In the first section of the coil 109-*i*-3-*a*, the second fluid 115-*i*-3-*a* may be formed at one set of flow conditions based on the flow rate and diameter 116-*i*-3-*a*. The mixed flow then may enter the second section of the coil 109-*i*-3-*b* where the diameter 116-*i*-3-*b* may be dramatically different, changing the hydrodynamics considerably. The second fluid that may be partially solidified in the first section of the coil now may adapt to the new flow conditions. This new form 115-*i*-3-*b* may include a change in diameter, a change in shape from spherical to elliptical, a change in position/velocity within the coil to manipulate heat transfer, and/or a breakage in the partially solidified particles to re-form into non-geometric highly organic shapes. The outlet of this coil may produce a mixed flow 106-*i*-3 of the two fluids at the desired solidification limit. System 100-*i*-4 may show a coil with two different orientations with respect to gravity and two different diameters. The first fluid 104-*i*-4 and the second fluid 102-*i*-4 may be mixed in the mixing nozzle 108-*i*-4 and then may enter the coil. In the first section of the coil 109-*i*-4, the second fluid 115-*i*-4-*a* may be formed at one set of flow conditions based on the flow rate and diameter 116-*i*-4-*a*. The mixed flow then may enter the second section of the coil, which may also be the storage container 103-*i*-4 for the first fluid. Although this section of the coil may be considered a container, that may be only because it may have a large overall diameter 116-*i*-4-*b*. In this section of the coil, gravitational acceleration may pull the partially solidified second fluid down toward the flow of the mixture from the first section of the coil. This may create a fluidized bed that may continually mix the solidifying second fluid 115-*i*-4-*b* with the first fluid coming from the first section of the coil. The desirably solidified solid second fluid 106-*i*-4 may then be taken from the container and the first fluid 104-*i*-4 may be taken from the container to recirculate through the system. FIG. 7 is exemplary in nature. The combinations of different sections of the coil may be done in any number of ways and different features may be combined to produce a solid particle or mass of different shape and size. Furthermore, the different sections may be combined in order to produce optimum heat transfer resulting in a desired solid particle size, smaller overall equipment size, and/or more efficient operation.

Figure 8:
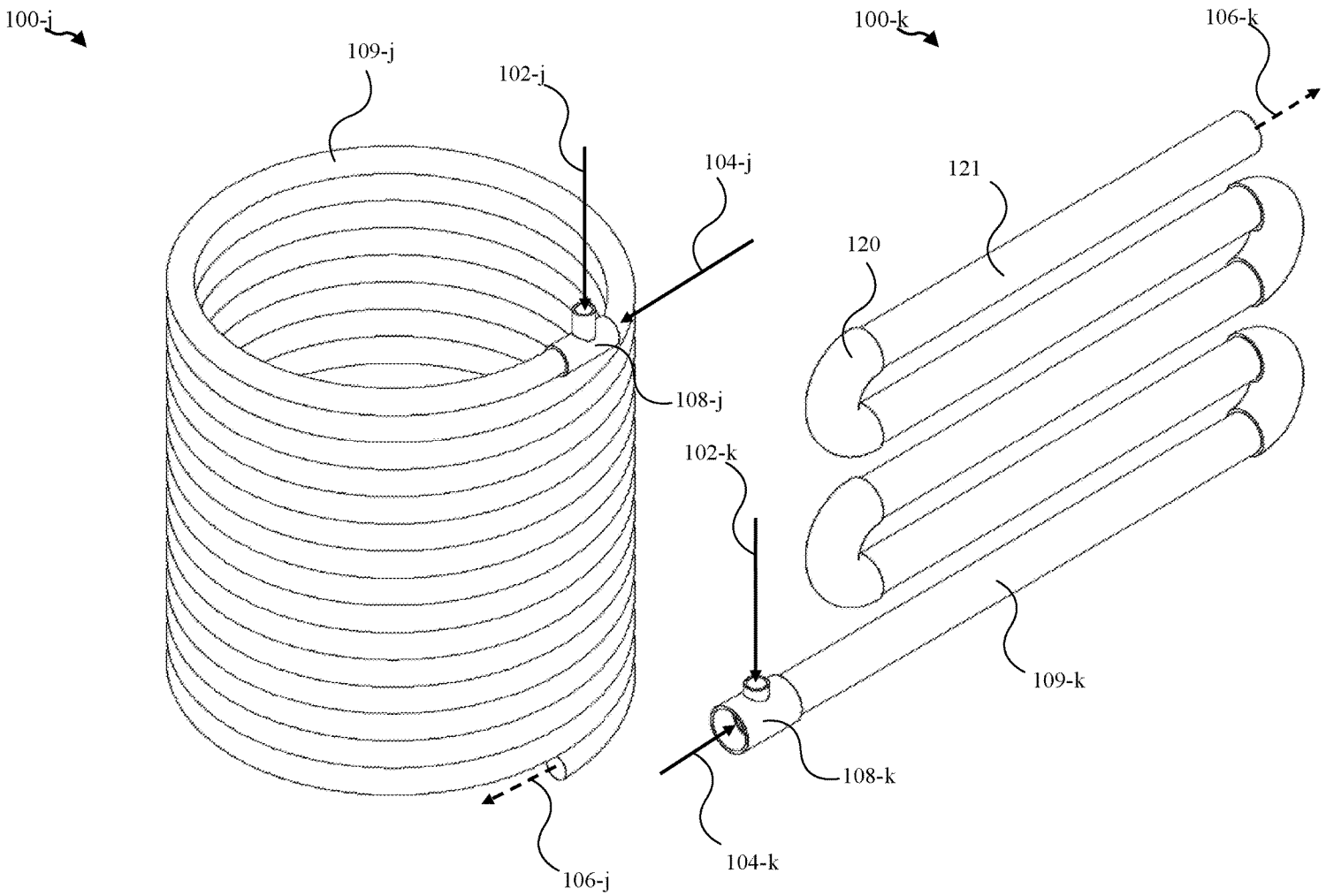
FIG. 8 shows systems in accordance with various embodiments.

FIG. 8 provide systems 100-*j* and 100-*k* that may show how a coil 109 may be constructed using round cross sections in accordance with various embodiments. Systems 100-*j* and/or 100-*k* may be examples of aspects of system 100 of FIG. 1A, system 100-*a* of FIG. 1B, system 100-*c* of FIG. 2A, system 100-*d* of FIG. 2B, system 100-*e* of FIG. 3, and/or 100-*f* of FIG. 4. In the first system 100-*j*, a helical smooth surface coil 109-*j* may be shown. A first fluid 104-*j* may enter the mixing nozzle 108-*j* where a second fluid 102-*j* may be injected. A mixture 106-*j* may flow through the coil 109-*j* until the second fluid 102-*j* may be solidified to the desired degree. In the second example 140, a fluid that includes a first fluid 104-*k* and a second fluid 102-*k* may flow through a coil 109-*k* made of straight sections 121 and curved sections 120. The first fluid 104-*k* may be injected into the mixing nozzle 108-*k* where it may be mixed with the second fluid 102-*k*. After this, the mixtures may flow through the straight sections 121 and the curved sections 120 until the second fluid 102-*k* may solidify to a desired level before exiting 106-*k*. These two examples are only exemplary. They may illustrate how coils may be made of continuous or discrete sections, for example. Furthermore, and considering the features described in FIG. 7, these manufacturing techniques may not need to be consistent throughout the entire coil.

Figure 9:
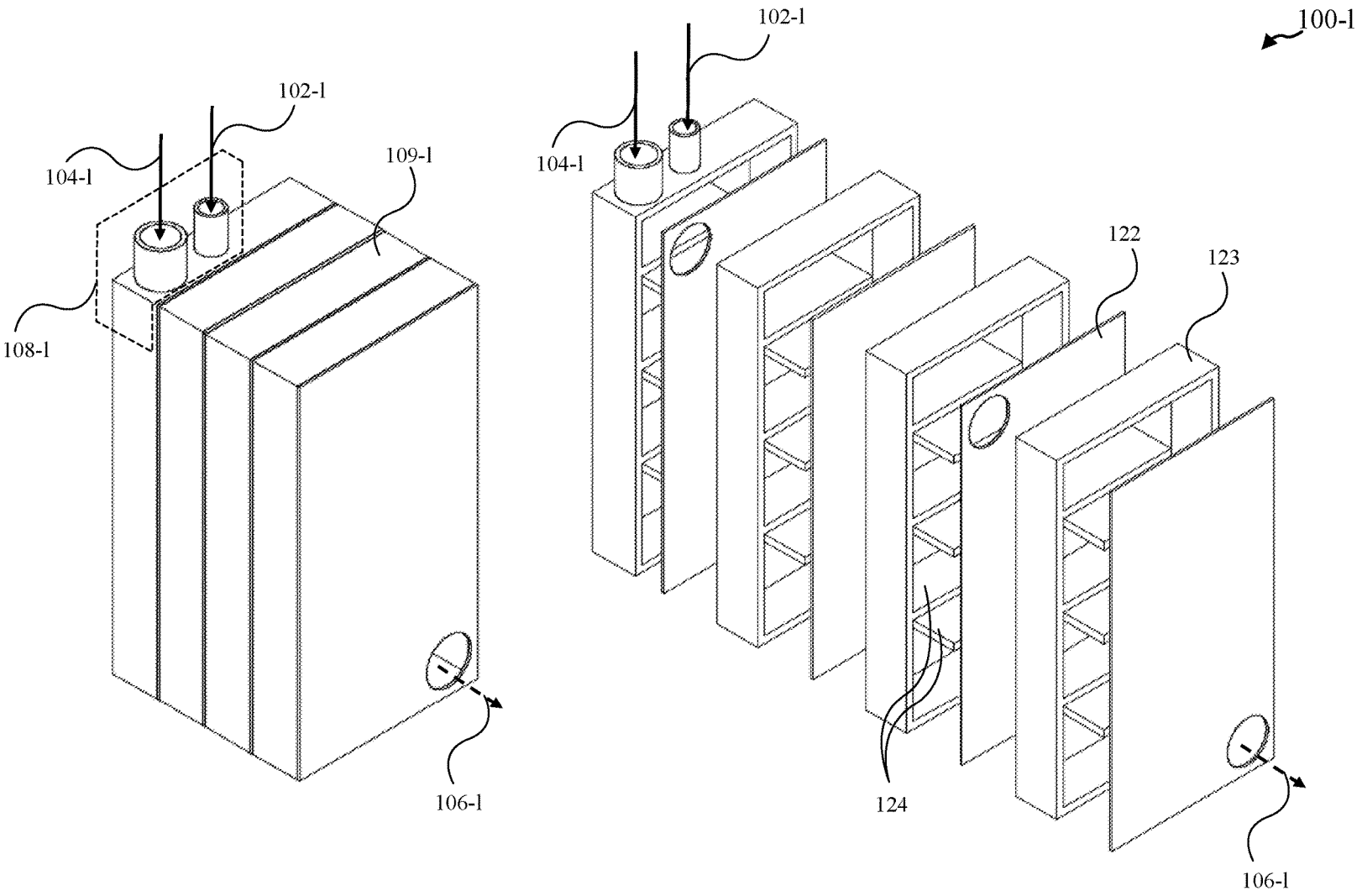
FIG. 9 shows a system in accordance with various embodiments.

FIG. 9 provides two views of a system 100-1 that may include a coil 109-1 with a rectangular profile in accordance with various embodiments; the views may include an assembled view and an exploded view. System 100-1 may be an example of aspects of system 100 of FIG. 1A, system 100-*a* of FIG. 1B, system 100-*c* of FIG. 2A, system 100-*d* of FIG. 2B, system 100-*e* of FIG. 3, and/or system 100-*f* of FIG. 4. This example may illustrate that the term coil may not be reserved to circular profiles but may include other profile shapes. The coil 109-1 may include repeated rectangular plates 123 that may be separated by flow control gaskets 122 that may route the fluid flow, which may include a first fluid 104-1 and a second fluid 102-1, from the visual top of the unit to the bottom and then into the next plate 123 where the flow may be opposite and may take the fluid back to the visual top of the coil. Addition internal alternating baffles 124 may provide a larger flow length and a desired flow channel dimension. In this coil, the first fluid 104-1 and the second fluid 102-1 may be injected at the inlet of the coil. The mixing nozzle 108-1 in this case may be directly integrated into the coil. The mixture may flow through the rectangular profile until it may reach the outlet flow 106-1 at the desired level of solidification. FIG. 9 is exemplary in nature. It may show how the coil described in accordance with various embodiments may not have a circular profile or an overall helical/circular nature.

Figure 10:
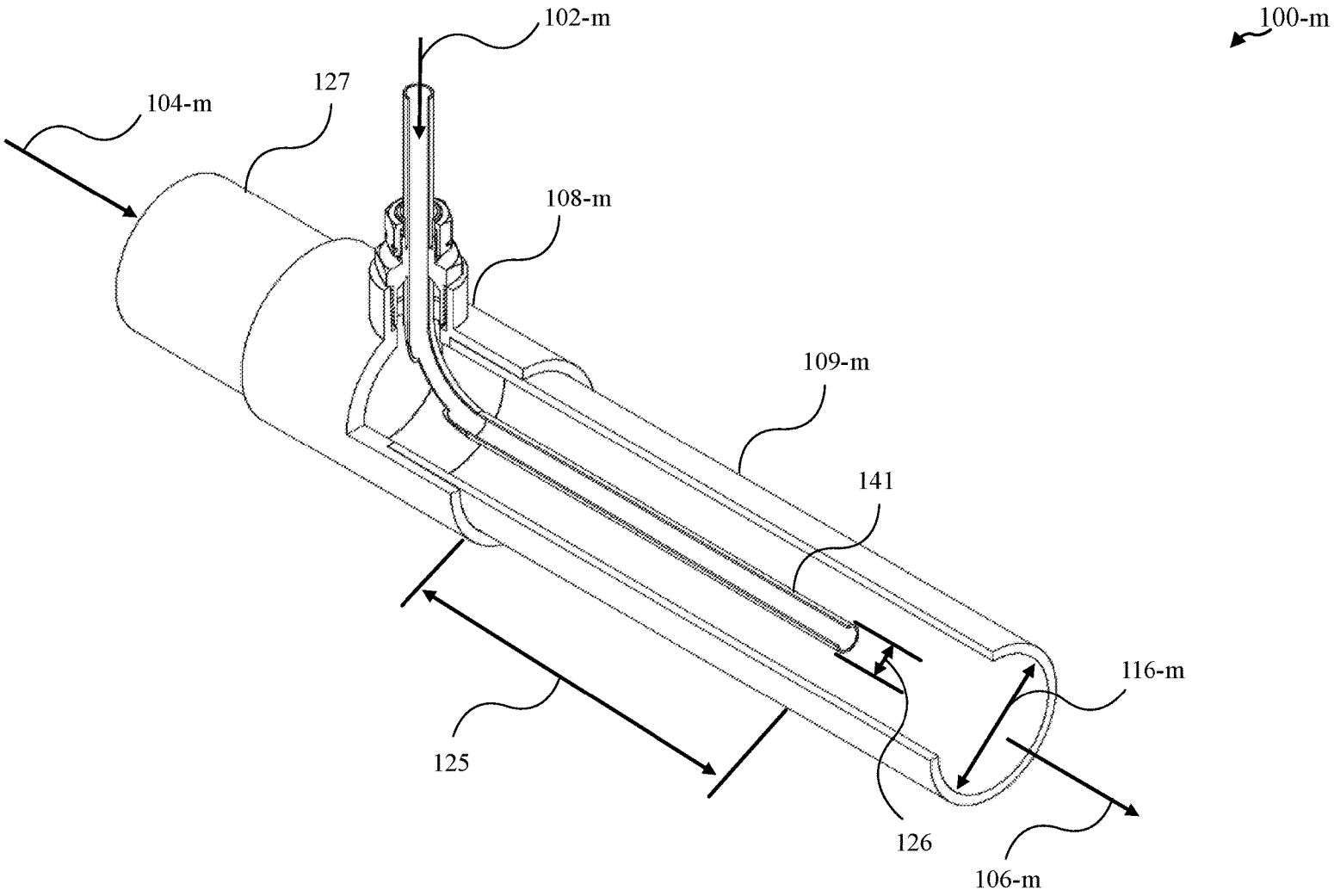
FIG. 10 shows a system in accordance with various embodiments.

FIG. 10 provides a system 100-*m* in accordance with various embodiments that may highlight another way of controlling the shape and/or size of a solidified second fluid 102-*m* with respect to a coil 109-*m* and mixing nozzle 108-*m*. Systems 100-*m* may be an example of aspects of system 100 of FIG. 1A, system 100-*a* of FIG. 1B, system 100-*c* of FIG. 2A, system 100-*d* of FIG. 2B, system 100-*e* of FIG. 3, and/or system 100-*f* of FIG. 4. A first fluid 104-*m* may enter the mixing nozzle 108-*m* through an entrance region 127 and then may enter the mixing nozzle itself 108-*m* when the fluids carrying the fluids may converge. The second fluid 102-*m* may enter the mixing nozzle 108-*m* but may not initially mix with the first fluid 104-*m*; instead, it may run in a tube 141 inside the mixing nozzle 108-*m* for a length 125 that may allow the flow of the first fluid 104-*m* to stabilize after the mixing nozzle 108-*m*. This region may exist inside the coil 109-*m*. The diameter of the inner tube 126 may be selected with respect to the diameter 116-*m* of the coil 109-*m* such that the shape and/or size of the resulting second fluid 102-*m* droplets may be well controlled in the outlet mixture 106-*m* and the final solidified shape of the solidified second fluid 102-*m* may be controlled. FIG. 10 may highlight how the mixing nozzle may also be designed to control the shape and size of the solid. If the diameters of these two tubes 126,116-*m* may be controlled properly, the relative velocity at the injection point may be controlled. If this relative velocity may be high, a small spherical solid may be created where as if this relative velocity may be low, a larger and elliptical solid may be created. Furthermore, this design may be independent of the flow conditions later downstream in the coil 109-*m*. As such, it may be possible to use this injection region to establish solid characteristics, such as ice characteristics, before the fully developed coil characteristics take over or to create sections with multiple injection points further downstream with very different properties.

Figure 11:
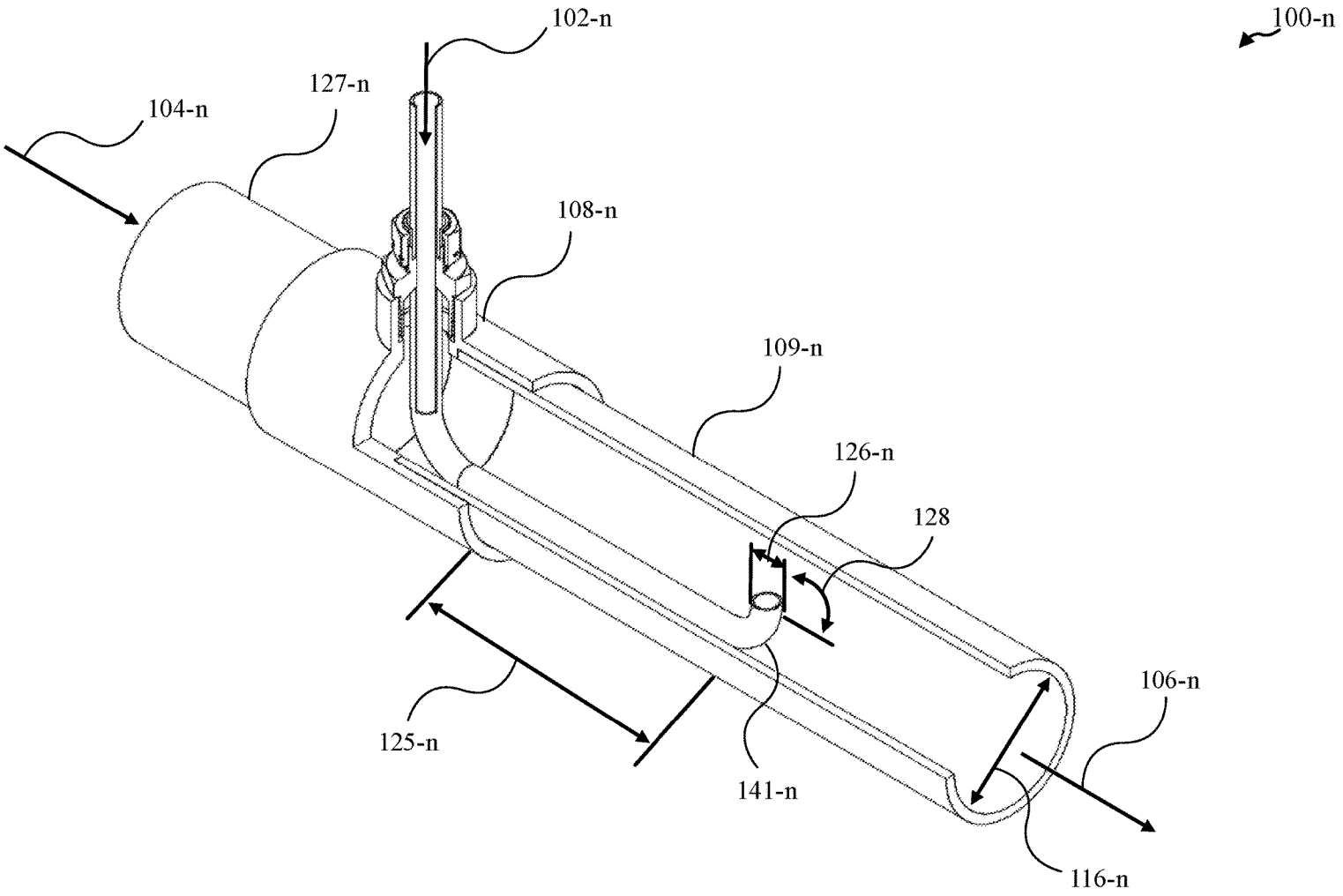
FIG. 11 shows a system in accordance with various embodiments.

FIG. 11 provides a system 100-*n* in accordance with various that may highlight another way of controller the shape and/or size of a solidified second fluid with respect to a coil 109-*n* and mixing nozzle 108-*n* in accordance with various embodiments. Systems 100-*n* may be an example of aspects of system 100 of FIG. 1A, system 100-*a* of FIG. 1B, system 100-*c* of FIG. 2A, system 100-*d* of FIG. 2B, system 100-*e* of FIG. 3, and/or system 100-*f* of FIG. 4. A first fluid 104-*n* may enter the mixing nozzle 108-*n* through an entrance region 127-*n* and then may enter the mixing nozzle 108-*n* itself when the fluids carrying the fluids may converge. A second fluid 102-*n* may enter the mixing nozzle 108-*n* but may not initially mix with the first fluid 104-*n*; instead, it may run in a tube 141-*n* inside the mixing nozzle for a length 125-*n* that may allow the flow of the first fluid 104-*n* to stabilize after the mixing nozzle 108-*n*. This region may exist inside the coil 109-*n*. The diameter of the inner tube 126-*n* and the geometry of the injection nozzle, for example the angle 128, may be selected with respect to the diameter of the coil 116-*n* such that the shape and/or size of the resulting second fluid droplets may be well controlled in the outlet mixture 106-*n* and the final solidified shape of the solidified second fluid may be controlled. FIG. 11 may highlight how the mixing nozzle 108-*n* may also be designed to control the shape and/or size of the solid. If the diameters of these two tubes 126-*n*,116-*n* may be controlled properly, the relative velocity at the injection point may be controlled. If this relative velocity may be high, a small spherical solid may be created where as if this relative velocity may be low, a larger and elliptical solid may be created. Furthermore, this design may be independent of the flow conditions later downstream in the coil 109-*n*. As such, it may be possible to use this injection region to establish solid characteristics, such as ice characteristics, before the fully developed coil characteristics may take over or to create sections with multiple injection points further downstream with very different properties.

Turning now to FIGS. 12-16, some embodiments may utilize a cold surface that may be protected by a first fluid. A second fluid may be allowed to come in near contact with the cold surface and solidify. The protection from the immiscible fluid may allow for the solid to be removed using a less or minimally complicated and/or low power mechanical device.

The fluids used in various embodiments are generally immiscible, which may allow for them to physically and/or thermally contact each other throughout the process. Additionally, the first fluid may be chosen based on its affinity for the cold surface. If it has a higher affinity for the surface than the second fluid, surface tension effects may overpower buoyancy or mechanical forces and the cold surface may be protected.

In some embodiments, the first fluid is a non-polar material and the second fluid is a polar material. For example, the first fluid may include a hydrocarbon, aromatic, fluorinated, or silicone oil, where an example of the second fluid may include an immiscible polar fluid, such as water, acidic acid, formic acid or other carbocyclic acids, sulfuric acid, ethylene or polyethylene glycol, medium sized alcohols such as tert-butyl, or DMSO. In some embodiments, the first fluid is a polar material and the second fluid is a non-polar material. For example, the first fluid may include water, alcohol, propylene or ethylene glycol, DMSO, ammonia, or nitric acid where the second fluid may include a fluorinated oil, cresol, a high molecular weight silicon oil, a high molecular weight hydrocarbon oil or paraffin, a thermoset polymer, or a metallic alloy. In some embodiments, if the cold surface is a metal or plastic, the oil may preferentially cover the surface protecting it even under high hydrostatic or mechanical loading from the water, which may allow for high heat transfer between the water and cold surface but leaving the water poorly adhered to the surface so it may be removed with low power and mechanical complexity.

Figure 12:
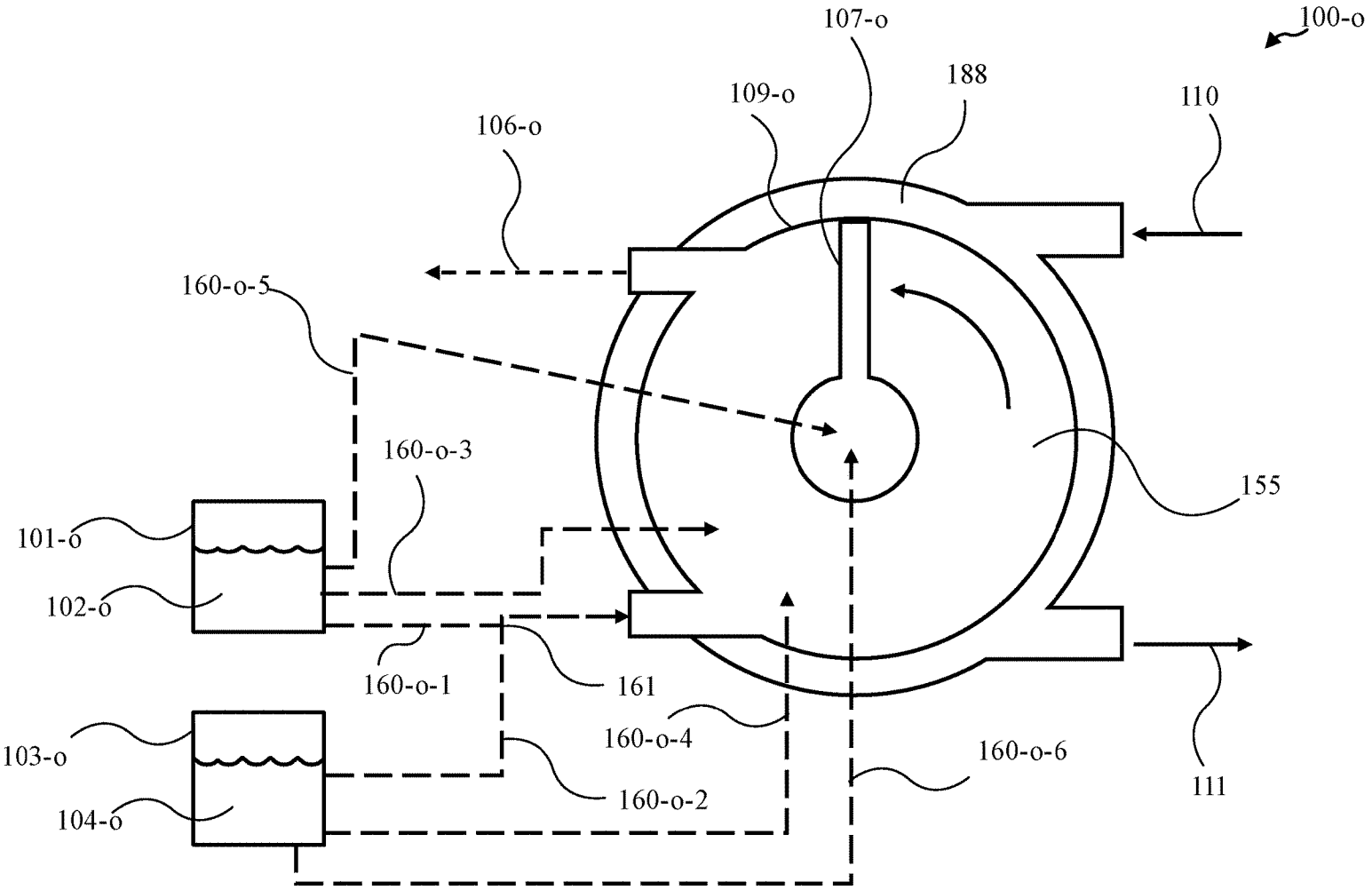
FIG. 12 shows a system in accordance with various embodiments.

For example, FIG. 12 shows a system 100-*o* for solid production in accordance with various embodiments. System 100-*o* may be an example of system 100 of FIG. 1A and/or system 100-*b* of FIG. 1C.

A first fluid 104-*o* may be released from a storage container 103-*o* and allowed to flow into a volume 155. A second fluid 102-*o* may be released from a storage container 101-*o* and allowed to flow into the same volume 155. The first fluid 104-*o* and the second fluid 102-*o* may be immiscible with respect to each other. Inside the volume 155, there may a mechanism such as solid remover 107-*o*, that may move along a cold surface 109-*o* that surrounds the volume 155. The first fluid 104-*o* may have an affinity for the surface 109-*o* such that the second fluid 102-*o* may approach the cold surface 109-*o* and may solidify due to its cold temperature, but it cannot adhere well to the surface 109-*o*. This may allow the solid remover 107-*o* to remove solid form of the second fluid 102-*o* from the surface 109-*o* at a low speed and torque. The second fluid 102-*o* may solidify to the desired solid content before leaving the system as a mixture of the first fluid and the second fluid 106-*o*. The cold surface 109-*o* may be maintained by a second volume 188 that may surround the first volume 155 and may be chilled with a supply of refrigerant 110. Once the refrigerant 110 removes heat from the cold surface 109-*o*, it may leave the system via as outlet refrigerant 111.

The first fluid 104-*o* and the second fluid 102-*o* may be delivered to the volume 155 and/or cold surfaced 109-*o* through a variety of conduits 160. For example, conduit 160-*o*-1 may deliver second fluid 102-*o* to a combiner 161 where it may be combined with the first fluid 104-*o* delivered through conduit 160-*o*-2; the combined fluids may then be delivered to the volume 155 and/or cold surface 109-*o*. In some embodiments, the first fluid 104-*o* and the second fluid 102-*o* may be separately delivered to volume 155 and/or cold surface 109-*o*. For example, conduit 160-*o*-3 may deliver the second fluid 102-*o* separately from the first fluid 104-*o* delivered through conduit 160-*o*-4. In some embodiments, the first fluid 104-*o* may be delivered to the volume 155 and/or cold surface 109-*o* through conduit 160-*o*-6 that may be coupled with the solid remover 107-*o*, which may facilitate deliver of the first fluid 104-*o* to the cold surface 109-*o*. In some embodiments, the second fluid 102-*o* may be delivered to the volume 155 and/or cold surface 109-*o* through conduit 160-*o*-5 that may be coupled with the solid remover 107-*o*, which may facilitate deliver of the second fluid 102-*o* to the cold surface 109-*o*. In some embodiments, the first fluid 104-*o* may be delivered to the volume 155 and/or cold surface 109-*o* through conduit 160-*o*-6 coupled with solid remover 107-*o*, while the second fluid 102-*o* may be delivered through conduit 160-*o*-3.

Figure 13:
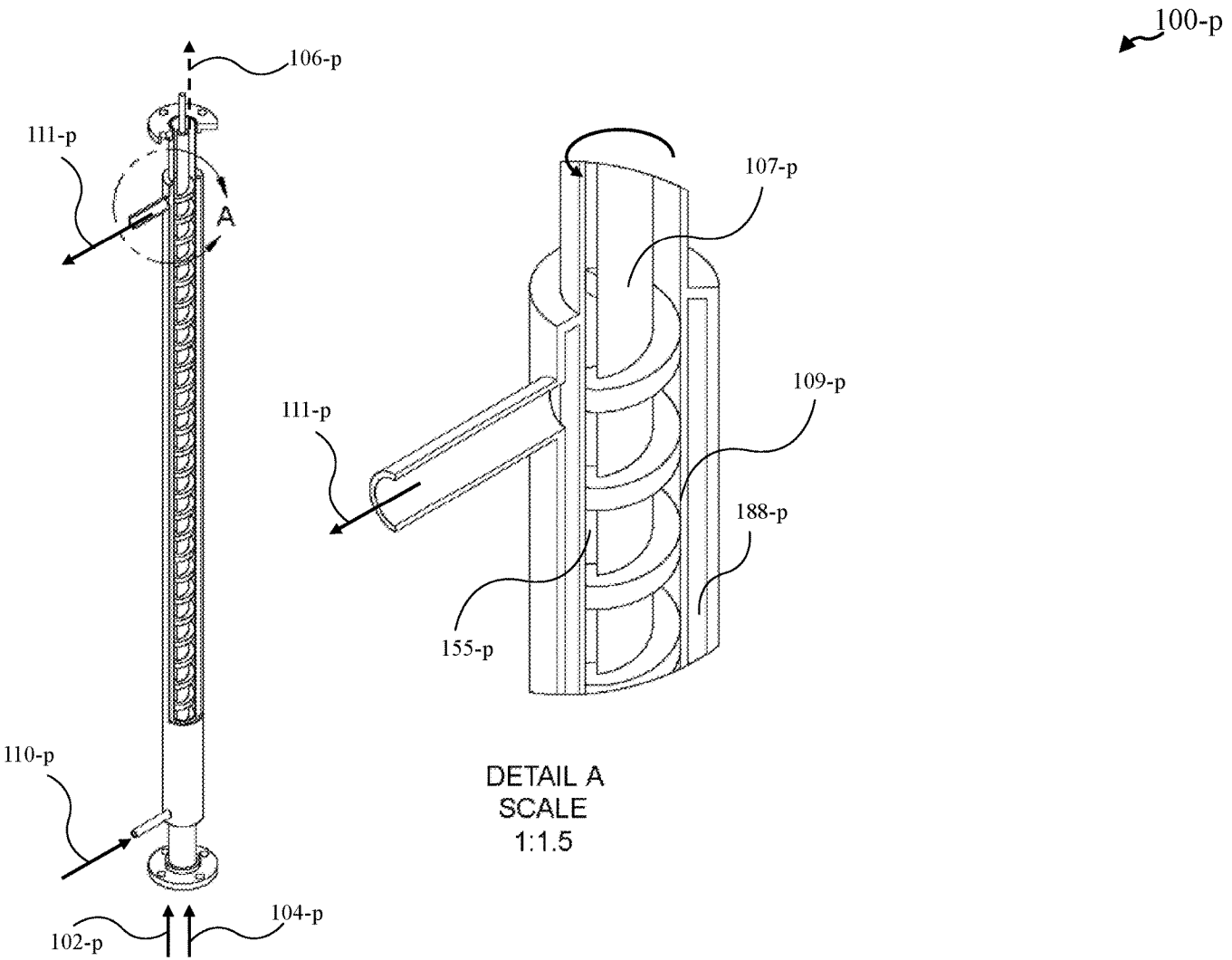
FIG. 13 shows a system in accordance with various embodiments.

FIG. 13 shows a system 100-*p* for solid production in accordance with various embodiments; detail A of system 100-*p* may be highlighted also. System 100-*p* may be an example of system 100 of FIG. 1A, system 100-*b* of FIG. 1C, and/or system 100-*o* of FIG. 12. System 100-*p* may show an embodiment where a cold surface 109-*p* is the inside surface of a jacketed tube-in-tube heat exchanger and the solid remover includes an auger 107-*p*. A first fluid 104-*p* may be supplied to the internal volume 155-*p* simultaneous to the supply of a second fluid 102-*p*. The first fluid 104-*p* may have an affinity for the cold surface 109-*p*. The first fluid 104-*p* and the second fluid 102-*p* may be immiscible with respect to each other. The cold surface 109-*p* may comprise the entire cylindrical form of the device with the auger 107-*p* at the center that scrapes the cold surface 109-*p*. The heat may be removed from the cold surface 109-*p* by a jacketed volume 188-*p* that may be filled with refrigerant 110-*p*, and may exit as outlet refrigerant flow 111-*p*. The first fluid 104-*p* and the second fluid 104-*p* may leave the volume as a mixture 106-*p* after the second fluid 102-*p* has solidified to the desired level.

Figure 14:
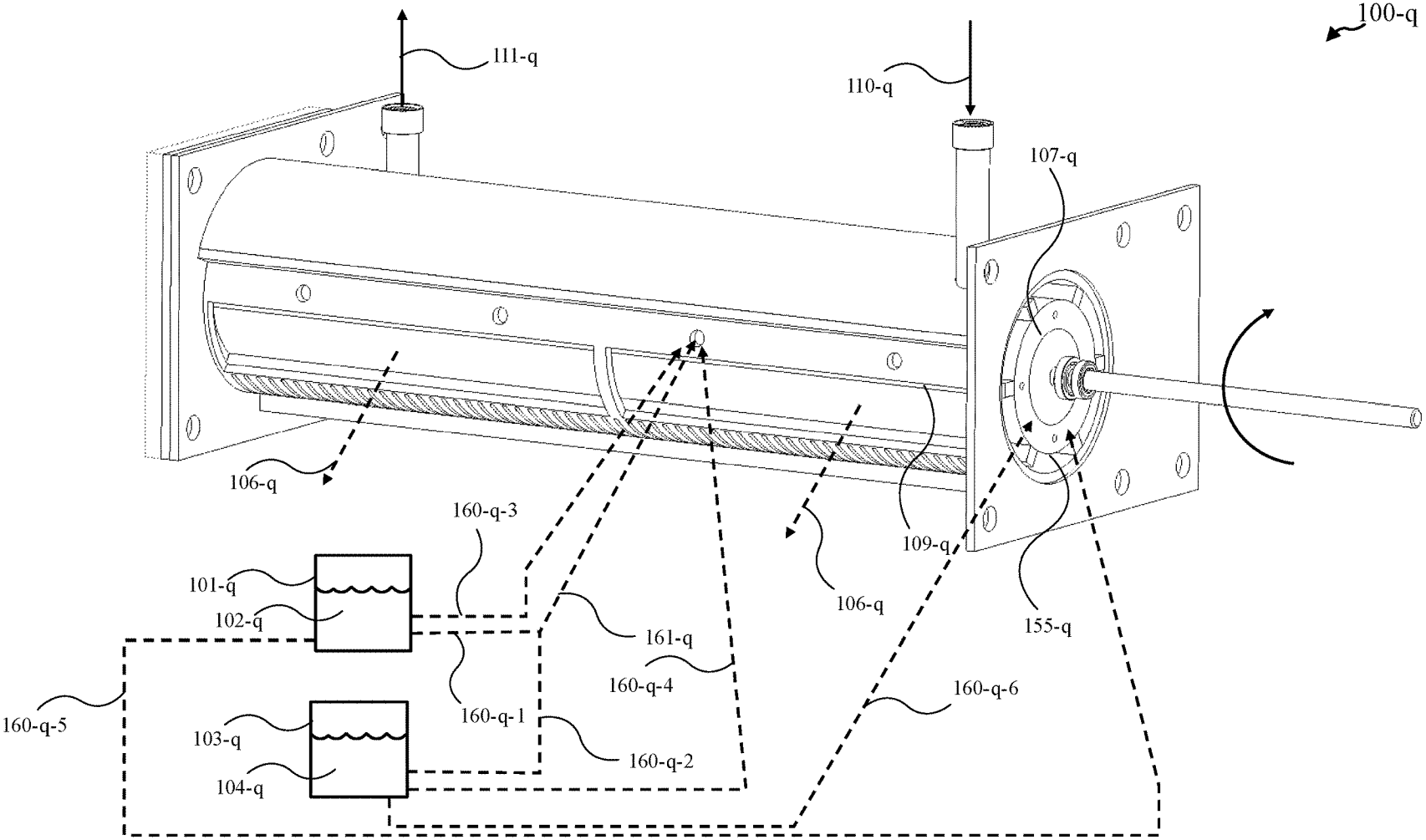
FIG. 14 shows a system in accordance with various embodiments.

FIG. 14 shows a system 100-*q* for solid production in accordance with various embodiments. System 100-*q* may be an example of system 100 of FIG. 1A, system 100-*b* of FIG. 1C, and/or system 100-*o* of FIG. 12. With respect to system 100-*q*, a cold surface 109-*q* may be wrapped around a drum with a rotating tool 107-*q* inside that may remove the solid. A first fluid 104-*q* may be released from a storage container 103-*q* while a second fluid 102-*q* may be released from a second storage container 101-*q*. The first fluid 104-*q* may have an affinity for the cold surface 109-*p*. The first fluid 104-*q* and the second fluid 102-*q* may be immiscible with respect to each other. The first fluid 104-*q* and the second fluid 102-*q* may flow within a volume 155-*q* inside the drum that may not occupied by the rotating tool 107-*q* where the second fluid 102-*q* solidifies. It then may leave as a mixture of solid and liquid 106-*q*. The drum may be cooled by an external volume that may hold a refrigerant flowing as an inlet flow 110-*q* to an outlet flow 111-*q*.

The first fluid 104-*q* and the second fluid 102-*q* may be delivered to the volume 155-*q* and/or cold surface 109-*q* through a variety of conduits 160-*q*. For example, conduit 160-*q*-1 may deliver second fluid 102-*q* to a combiner 161-*q* where it may be combined with the first fluid 104-*q* delivered through conduit 160-*q*-2; the combined fluids may then be delivered to the volume 155-*q* and/or cold surface 109-*q*.

In some embodiments, the first fluid 104-*q* and the second fluid 102-*q* may be separately delivered to volume 155-*q* and/or cold surface 109-*q*. For example, conduit 160-*q*-3 may deliver the second fluid 102-*q* separately from the first fluid 104-*q* delivered through conduit 160-*q*-4. In some embodiments, the first fluid 104-*q* may be delivered to the volume 155-*q* and/or cold surface 109-*q* through conduit 160-*q*-6 that may be coupled with the rotating tool 107-*q*, which may facilitate deliver of the first fluid 104-*q* to the cold surface 109-*q*. In some embodiments, the second fluid 102-*q* may be delivered to the volume 155-*q* and/or cold surface 109-*q* through conduit 160-*q*-5 that may be coupled with the rotating tool 107-*q*, which may facilitate deliver of the second fluid 102-*q* to the cold surface 109-*q*. In some embodiments, the first fluid 104-*q* may be delivered to the volume 155-*q* and/or cold surface 109-*q* through conduit 160-*q*-6 coupled with rotating tool 107-*q*, while the second fluid 102-*q* may be delivered through conduit 160-*q*-3.

Figure 15:
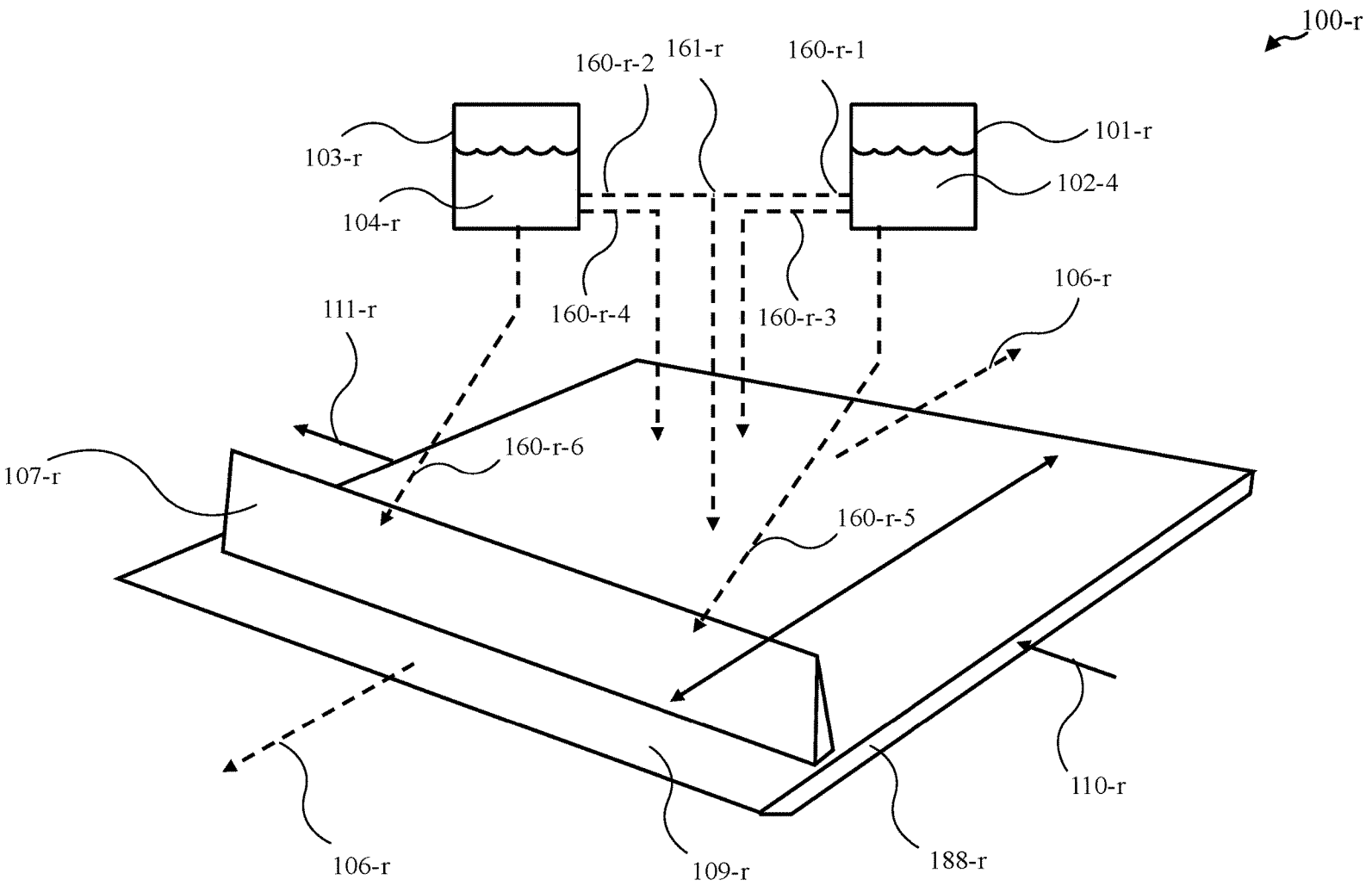
FIG. 15 shows a system in accordance with various embodiments.

FIG. 15 shows a system 100-*r* for solid production in accordance with various embodiments. System 100-*r* may be an example of system 100 of FIG. 1A and/or system 100-*b* of FIG. 1C. With respect to system 100-*r*, a first fluid 104-*r* may be released from a storage container 103-*r*, while a second fluid 102-*r* may be released from a second storage container 101-*r*. The first fluid 104-*r* and/or the second fluid 102-*r* may be allowed to flow onto a cold surface 109-*r*. The first fluid 104-*r* may have an affinity for the cold surface 109-*r*. The first fluid 104-*r* and the second fluid 102-*r* may be immiscible with respect to each other. On top of this surface there may be a mechanism, such as a linear scrapper 107-*r*, that may move along the cold surface 109-*r*. The first fluid's affinity for the surface 109-*r* may mean that the second fluid 102-*r* may approach the cold surface 109-*r* and solidify due to its cold temperature, but it cannot adhere well to the surface 109-*r*. This may allow the mechanism 107-*r* to remove solid from the surface 107-*r* at a low speed and torque. The second fluid 102-*r* may solidify to the desired solid content before leaving the surface 109-*r* as a mixture of the first fluid and the second fluid 106-*r*. The cold surface 109-*r* may be maintained by a volume 188-*r* that may boarder one side of the surface 109-*r* and may be chilled with a supply of refrigerant flow 110-*r*. Once the refrigerant removes heat from the cold surface 109-*r*, it may leave the volume 188-*r* via outlet refrigerant flow 111-*r*.

The first fluid 104-*r* and the second fluid 102-*r* may be delivered to the cold surface 109-*r* through a variety of conduits 160-*r*. For example, conduit 160-*r*-1 may deliver second fluid 102-*r* to a combiner 161-*r* where it may be combined with the first fluid 104-*r* delivered through conduit 160-*r*-2; the combined fluids may then be delivered to the cold surface 109-*r*. In some embodiments, the first fluid 104-*r* and the second fluid 102-*r* may be separately delivered to the cold surface 109-*r*. For example, conduit 160-*r*-3 may deliver the second fluid 102-*r* separately from the first fluid 104-*r* delivered through conduit 160-*r*-4. In some embodiments, the first fluid 104-*r* may be delivered to the cold surface 109-*r* through conduit 160-*r*-6 that may be coupled with the linear scrapper 107-*r*, which may facilitate deliver of the first fluid 104-*r* to the cold surface 109-*r*. In some embodiments, the second fluid 102-*r* may be delivered to the cold surface 109-*r* through conduit 160-*r*-5 that may be coupled with the linear scraper 107-*r*, which may facilitate deliver of the second fluid 102-*r* to the cold surface 109-*r*. In some embodiments, the first fluid 104-*r* may be delivered to the cold surface 109-*r* through conduit 160-*r*-6 coupled with linear scrapper 107-*r*, while the second fluid 102-*r* may be delivered through conduit 160-*r*-3.

Figure 16:
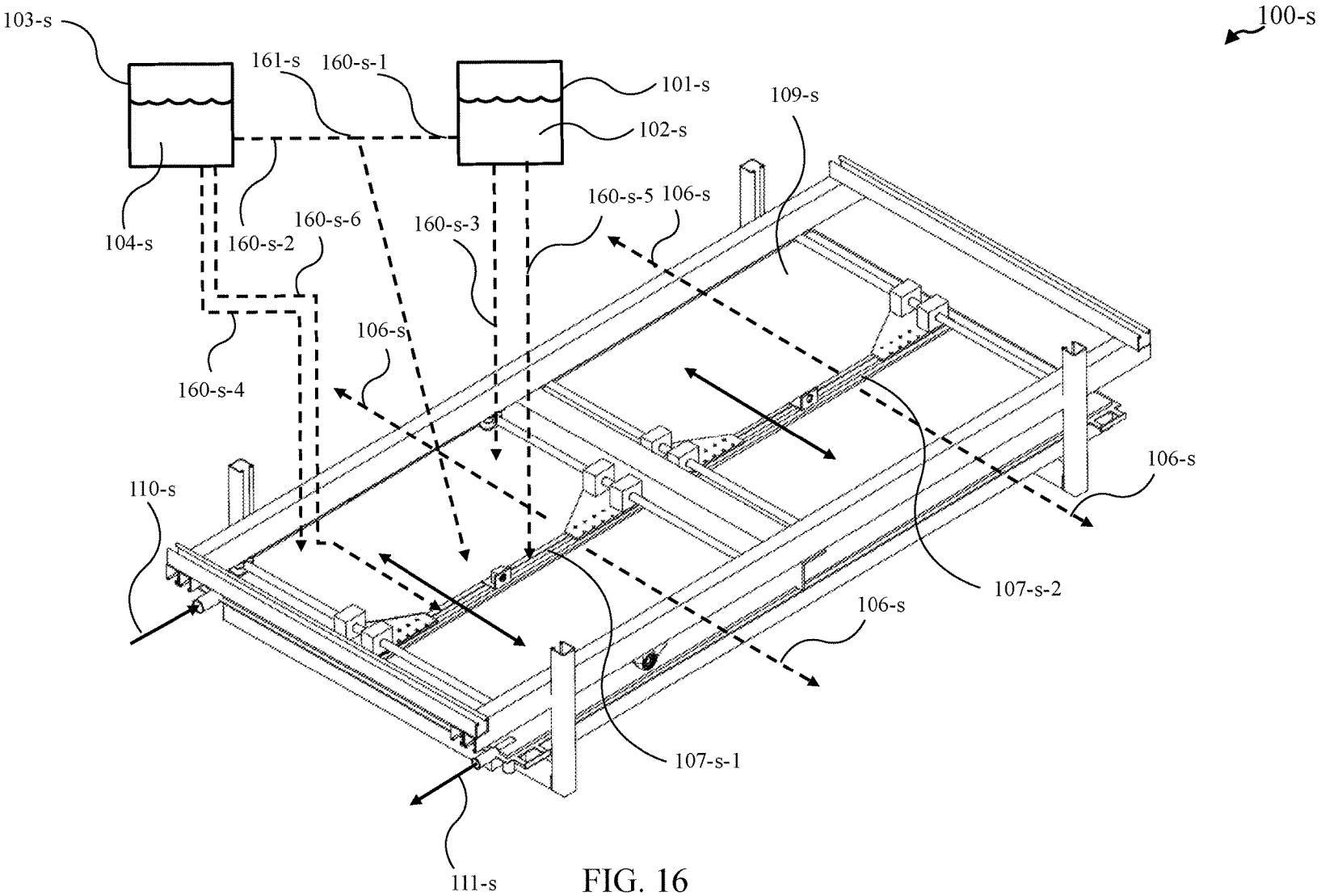
FIG. 16 shows a system in accordance with various embodiments.

FIG. 16 shows a system 100-*s* for solid production in accordance with various embodiments. System 100-*s* may be an example of system 100 of FIG. 1A, system 100-*b* of FIG. 1C, and/or system 100-*r* of FIG. 15. With respect to system 100-*s*, a first fluid 104-*s* may be released from a storage container 103-*s*; a second fluid 104-*s* may be released from a second storage container 101-*s*. The first fluid 104-*s* and the second fluid 102-*s* may be immiscible with respect to each other. The first fluid 104-*s* and the second fluid 102-*s* may be allowed to flow onto a cold surface 109-*s*. The first fluid 104-*s* may have an affinity for the cold surface 109-*s*. On top of this surface 109-*s*, there may be two parallel mechanisms, such as linear scrappers 107-*s*-1 and 107-*s*-1, that may move back and forth over the cold surface 109-*s*. The second fluid 102-*s* may solidify to the desired solid content before leaving the surface 109-*s* as a mixture 106-*s* of the first fluid 104-*s* and the second fluid 102-*s*. The cold surface 109-*s* may be maintained at a low temperature by a refrigerant 110-*s* flowing through a volume directly behind the surface 109-*s*. Once the refrigerant removes heat from the cold surface 109-*s*, it may leave the system via an outlet refrigerant flow 111-*s*.

The first fluid 104-*s* and the second fluid 102-*s* may be delivered to the cold surface 109-*s* through a variety of conduits 160-*s*. For example, conduit 160-*s*-1 may deliver second fluid 102-*s* to a combiner 161-*s* where it may be combined with the first fluid 104-*s* delivered through conduit 160-*s*-2; the combined fluids may then be delivered to the cold surface 109-*s*. In some embodiments, the first fluid 104-*s* and the second fluid 102-*s* may be separately delivered to the cold surface 109-*s*. For example, conduit 160-*s*-3 may deliver the second fluid 102-*s* separately from the first fluid 104-*s* delivered through conduit 160-*s*-4. In some embodiments, the first fluid 104-*s* may be delivered to the cold surface 109-*s* through conduit 160-*s*-6 that may be coupled with the linear scrapper 107-*s*-1 (and/or linear scrapper 107-*s*-2), which may facilitate deliver of the first fluid 104-*s* to the cold surface 109-*s*. In some embodiments, the second fluid 102-*s* may be delivered to the cold surface 109-*s* through conduit 160-*s*-5 that may be coupled with the linear scraper 107-*s*-1 (and/or linear scrapper 107-*s*-2), which may facilitate deliver of the second fluid 102-*s* to the cold surface 109-*s*. In some embodiments, the first fluid 104-*s* may be delivered to the cold surface 109-*s* through conduit 160-*s*-6 coupled with linear scrapper 107-*s*-1, while the second fluid 102-*s* may be delivered through conduit 160-*s*-3.

Figure 17A:
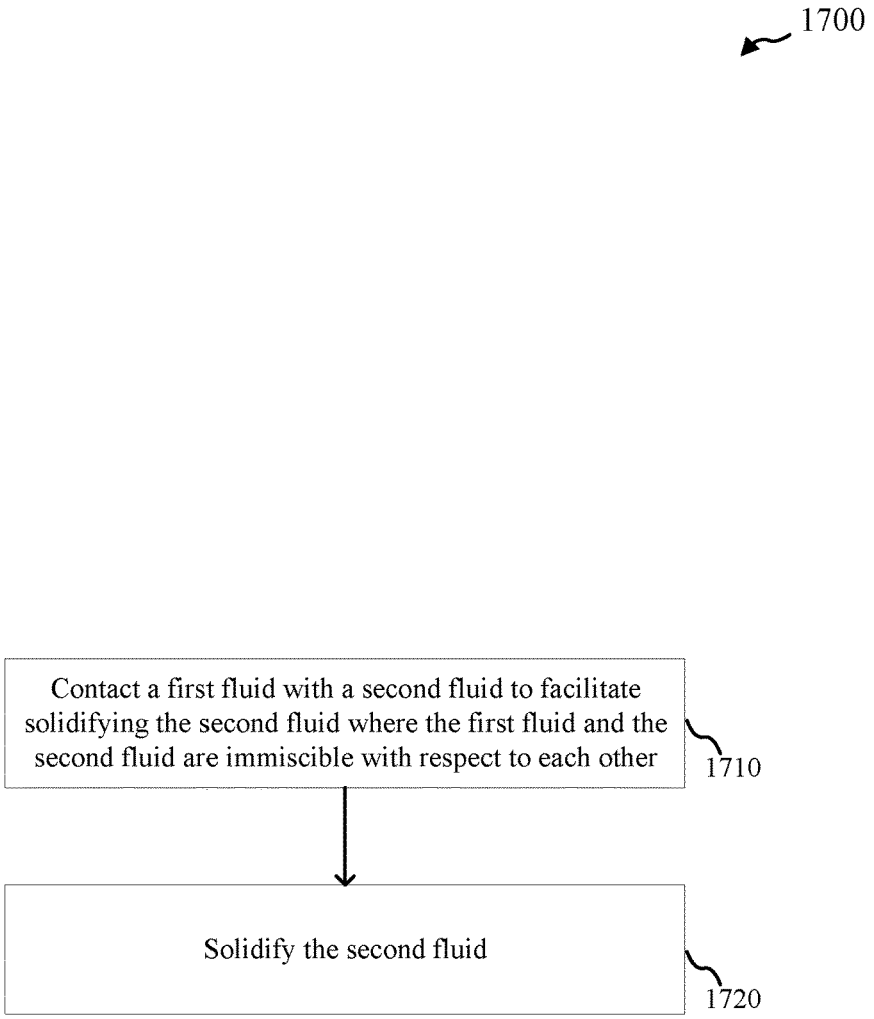
FIG. 17A shows block diagram of a method in accordance with various embodiments.

Turning now to FIG. 17A, a method of solid production is provided in accordance with various embodiments. Method 1700 may be implemented by a variety of systems such as those shown in FIG. 1A, FIG. 1B, FIG. 1C, FIG. 2A, FIG. 2B, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, and/or FIG. 16.

At block 1710, a first fluid may be contacted with a second fluid to facilitate solidifying the second fluid; the first fluid and the second fluid may be immiscible with respect to each other. At block 1720, the second fluid may be solidified.

In some embodiments of the method 1700, the first fluid includes a non-polar material and the second fluid includes a polar material. In some embodiments, the first fluid includes at least hydrocarbon oil, aromatic oil, fluorinated oil, or silicone oil. In some embodiments, the second fluid includes at least water, acidic acid, formic acid, carbocyclic acids, sulfuric acid, ethylene glycol, polyethylene glycol, tert-butyl, or DMSO.

In some embodiments of the method 1700, the first fluid includes a polar material and the second fluid includes a non-polar material. In some embodiments, the first fluid includes at least water, alcohol, propylene glycol, ethylene glycol, DMSO, ammonia, or nitric acid. In some embodiments, the second fluid includes at least fluorinated oil, cresol, high molecular weight silicon oil, high molecular weight hydrocarbon oil, high molecular weight paraffin, thermoset polymer, or metallic alloy. In some embodiments, the first fluid includes water and the second fluid includes at least high-molecular weight paraffin or thermoset polymer.

In some embodiments of the method 1700, contacting the first fluid with the second fluid includes entraining the second fluid within the first fluid. In some embodiments, the first fluid includes aromatic oil and the second fluid includes water. Some embodiments further include cooling the first fluid before entraining the second fluid within the first fluid. In some embodiments, the first fluid and the second fluid are cooled simultaneously.

In some embodiments of the method 1700, entraining the second fluid within the first fluid includes flowing the first fluid and the second fluid through a coil to solidify at least a portion of the second fluid. In some embodiments, one or more hydrodynamic properties of the first fluid form the second fluid into one or more solidified shapes. The one or more solidified shapes may be formed with at least a predictable size or a predictable shape. The one or more features of the coil may control the one or more hydrodynamic properties of the first fluid that form the second fluid into the one or more solidified shapes formed with at least the predictable size or the predictable shape. The one or more features of the coil may include at least one or more diameters of the coil, one or more geometries of the coil, one or more interior structures of the coil, one or more orientations of the coil, or one or more lengths of the coil. The one or more features of the coil may include a change in orientation of the coil. The one or more features of the coil may include a change in diameter of the coil.

In some embodiments of the method 1700, entraining the second fluid within the first fluid includes introducing the second fluid as a parallel flow to the first fluid. In some embodiments, entraining the second fluid within the first fluid includes introducing the second fluid as a perpendicular flow to the first fluid.

In some embodiments of the method 1700, contacting the first fluid with the second fluid includes introducing the first fluid and the second fluid with respect to one or more cold surfaces; the first fluid may have an affinity for the one or more cold surfaces. Some embodiments include removing a solidified form of the second fluid from the one or more cold surfaces. The first fluid may coat at least a portion of the one or more cold surfaces and interferes with the second fluid from adhering to the one or more cold surfaces. In some embodiments, the first fluid includes hydrocarbon oil and the second fluid includes water.

In some embodiments of the method 1700, contacting the first fluid with the second fluid includes mixing the second fluid with the first fluid before introducing the first fluid and the second fluid with respect to the one or more cold surfaces. In some embodiments, contacting the first fluid with the second fluid includes separately introducing the first fluid and the second fluid with respect to the one or more cold surfaces.

In some embodiments of the method 1700, the one or more cold surfaces are comprised of a metal. Some embodiments may include other materials such as plastic, ceramic, and/or glass for the one or more cold surfaces.

In some embodiments of the method 1700, removing the solidified form of the second fluid from the one or more cold surfaces includes utilizing an auger to remove the solidified form of the second fluid from a cylindrically-shaped cold surface. In some embodiments, removing the solidified form of the second fluid from the one or more cold surfaces includes utilizing a rotating scrapper to remove the solidified form of the second fluid from a drum-shaped cold surface. In some embodiments, removing the solidified form of the second fluid from the one or more cold surfaces includes utilizing one or more linear scrappers to remove the solidified form of the second fluid from one or more planar cold surfaces.

Figure 17B:
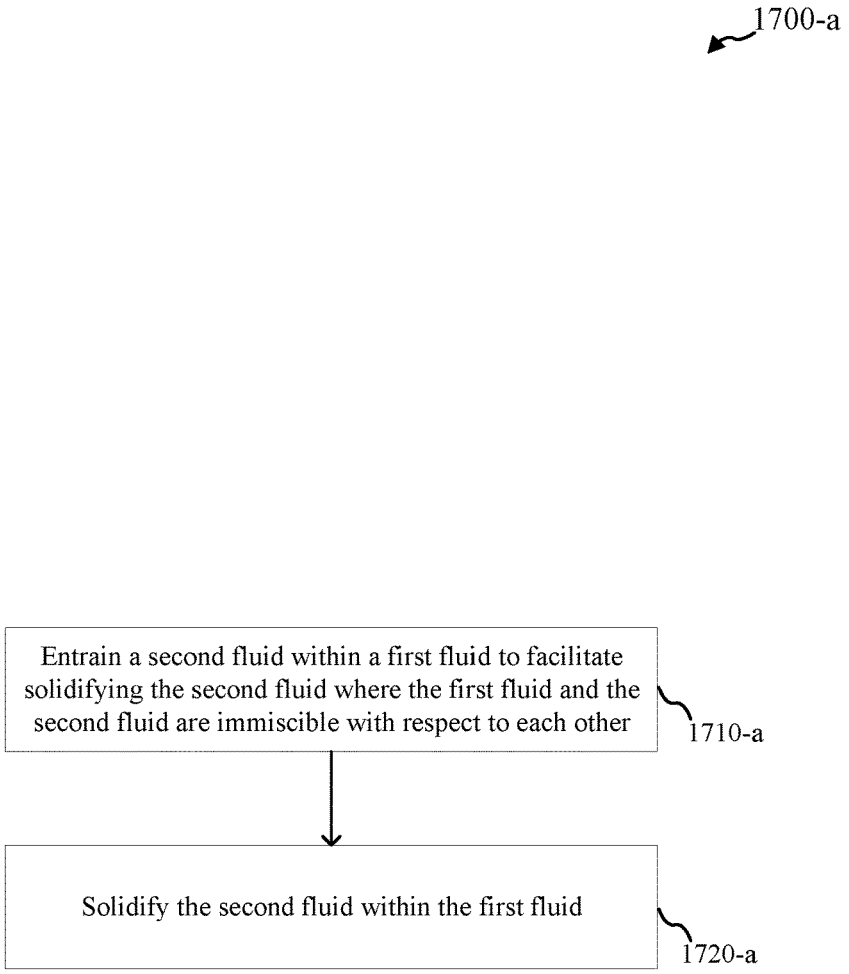
FIG. 17B shows block diagram of a method in accordance with various embodiments.

FIG. 17B shows a method 1700-*a* of solid production is provided in accordance with various embodiments. Method 1700-*a* may be implemented by a variety of systems such as those shown in FIG. 1A, FIG. 1B, FIG. 2A, FIG. 2B, FIG. 3, FIG. 4, FIG. 5, FIG. 6, FIG. 7, FIG. 8, FIG. 9, FIG. 10, and/or FIG. 11. Method 1700-*a* may be an example of method 1700 of FIG. 17A.

At block 1710-*a*, a second fluid may be entrained within a first fluid to facilitate solidifying the second fluid; the first fluid and the second fluid may be immiscible with respect to each other. At block 1720-*a*, the second fluid may be solidified within the first fluid.

Some embodiments of method 1700-*a* further include cooling the first fluid before entraining the second fluid within the first fluid. In some embodiments, the first fluid and the second fluid are cooled simultaneously.

In some embodiments of the method 1700-*a*, entraining the second fluid within the first fluid includes flowing the first fluid and the second fluid through a coil to solidify at least a portion of the second fluid. In some embodiments, one or more hydrodynamic properties of the first fluid form the second fluid into one or more solidified shapes. The one or more solidified shapes may be formed with at least a predictable size or a predictable shape. The one or more features of the coil may control the one or more hydrodynamic properties of the first fluid that form the second fluid into the one or more solidified shapes formed with at least the predictable size or the predictable shape. The one or more features of the coil may include at least one or more diameters of the coil, one or more geometries of the coil, one or more interior structures of the coil, one or more orientations of the coil, or one or more lengths of the coil. The one or more features of the coil may include a change in orientation of the coil. The one or more features of the coil may include a change in diameter of the coil.

In some embodiments of the method 1700-*a*, entraining the second fluid within the first fluid includes introducing the second fluid as a parallel flow to the first fluid. In some embodiments, entraining the second fluid within the first fluid includes introducing the second fluid as a perpendicular flow to the first fluid.

In some embodiments of method 1700-*a*, the first fluid includes a non-polar material and the second fluid includes a polar material. In some embodiments, the first fluid includes at least hydrocarbon oil, aromatic oil, fluorinated oil, or silicone oil. In some embodiments, the second fluid includes at least water, acidic acid, formic acid, carbocyclic acids, sulfuric acid, ethylene glycol, polyethylene glycol, tert-butyl, or DMSO. In some embodiments, the first fluid includes aromatic oil and the second fluid includes water.

In some embodiments of the method 1700-*a*, the first fluid includes a polar material and the second fluid includes a non-polar material. In some embodiments, the first fluid includes at least water, alcohol, propylene glycol, ethylene glycol, DMSO, ammonia, or nitric acid. In some embodiments, the second fluid includes at least fluorinated oil, cresol, high molecular weight silicon oil, high molecular weight hydrocarbon oil, high molecular weight paraffin, thermoset polymer, or metallic alloy. In some embodiments, the first fluid includes water and the second fluid includes at least high-molecular weight paraffin or thermoset polymer.

Figure 17C:
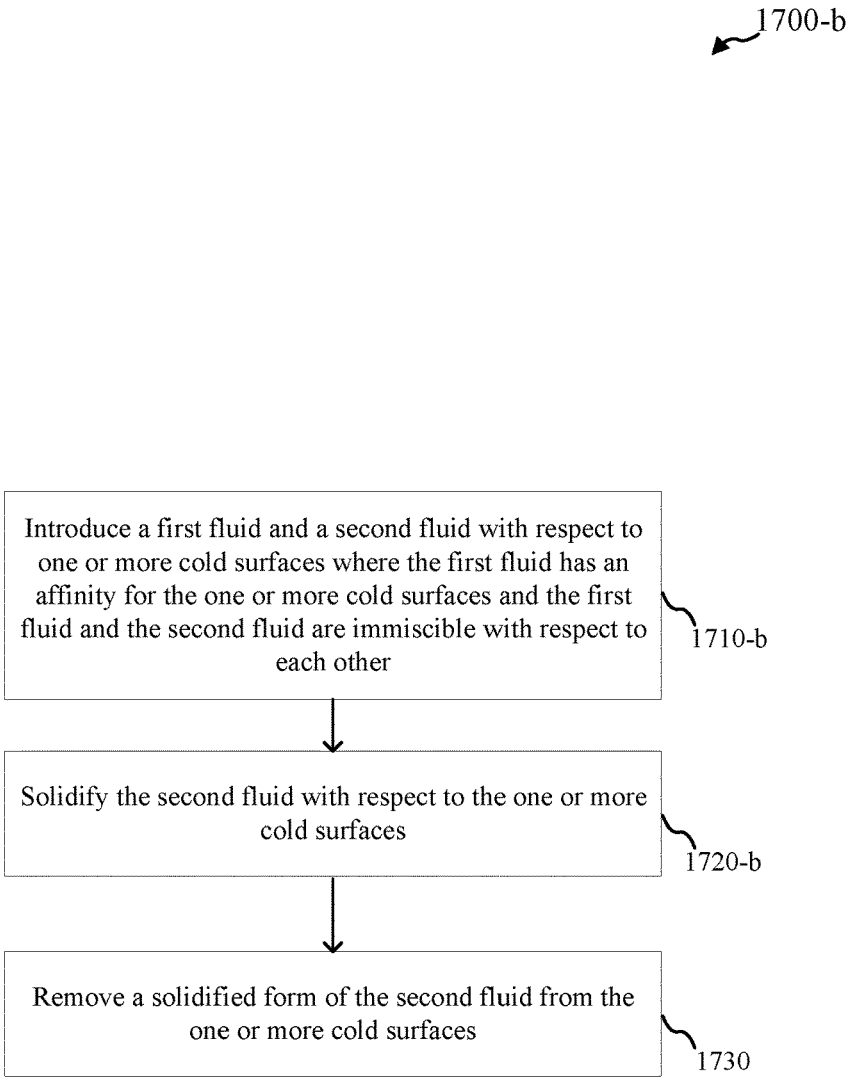
FIG. 17C shows block diagram of a method in accordance with various embodiments.

FIG. 17C shows a method 1700-*b* of solid production is provided in accordance with various embodiments. Method 1700-*b* may be implemented by a variety of systems such as those shown in FIG. 1A, FIG. 1C, FIG. 12, FIG. 13, FIG. 14, FIG. 15, and/or FIG. 16. Method 1700-*b* may be an example of method 1700 of FIG. 17A.

At block 1710-*b*, a first fluid and a second fluid may be introduced with respect to one or more cold surfaces. The first fluid may have an affinity for the one or more cold surfaces. Furthermore, the first fluid and the second fluid may be immiscible with respect to each other. At block 1720-*b*, the second fluid may be solidified with respect to the one or more cold surfaces. At block 1730, a solidified form of the second fluid may be removed from the one or more cold surfaces.

In some embodiments of method 1700-*b*, the first fluid may coat at least a portion of the one or more cold surfaces and interferes with the second fluid from adhering to the one or more cold surfaces. In some embodiments, the first fluid includes hydrocarbon oil and the second fluid includes water.

In some embodiments of the method 1700-*b*, contacting the first fluid with the second fluid includes mixing the second fluid with the first fluid before introducing the first fluid and the second fluid with respect to the one or more cold surfaces. In some embodiments, contacting the first fluid with the second fluid includes separately introducing the first fluid and the second fluid with respect to the one or more cold surfaces.

In some embodiments of the method 1700-*b*, the one or more cold surfaces are comprised of a metal. Some embodiments may include other materials such as plastic, ceramic, and/or glass for the one or more cold surfaces.

In some embodiments of the method 1700-*b*, removing the solidified form of the second fluid from the one or more cold surfaces includes utilizing an auger to remove the solidified form of the second fluid from a cylindrically-shaped cold surface. In some embodiments, removing the solidified form of the second fluid from the one or more cold surfaces includes utilizing a rotating scrapper to remove the solidified form of the second fluid from a drum-shaped cold surface. In some embodiments, removing the solidified form of the second fluid from the one or more cold surfaces includes utilizing one or more linear scrappers to remove the solidified form of the second fluid from one or more planar cold surfaces.

In some embodiments of method 1700-*b*, the first fluid includes a non-polar material and the second fluid includes a polar material. In some embodiments, the first fluid includes at least hydrocarbon oil, aromatic oil, fluorinated oil, or silicone oil. In some embodiments, the second fluid includes at least water, acidic acid, formic acid, carbocyclic acids, sulfuric acid, ethylene glycol, polyethylene glycol, tert-butyl, or DMSO. In some embodiments, the first fluid includes hydrocarbon oil and the second fluid includes water.

In some embodiments of the method 1700-*b*, the first fluid includes a polar material and the second fluid includes a non-polar material. In some embodiments, the first fluid includes at least water, alcohol, propylene glycol, ethylene glycol, DMSO, ammonia, or nitric acid. In some embodiments, the second fluid includes at least fluorinated oil, cresol, high molecular weight silicon oil, high molecular weight hydrocarbon oil, high molecular weight paraffin, thermoset polymer, or metallic alloy. In some embodiments, the first fluid includes water and the second fluid includes at least high-molecular weight paraffin or thermoset polymer.

These embodiments may not capture the full extent of combination and permutations of materials and process equipment. However, they may demonstrate the range of applicability of the method, devices, and/or systems. The different embodiments may utilize more or fewer stages than those described.

It should be noted that the methods, systems and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, several stages may be under-taken before, during, or after the above elements are considered. Accordingly, the above description should not be taken as limiting the scope of the different embodiments.

What is claimed is:

1. A method of solid production comprising:

contacting a first fluid with a second fluid to facilitate solidifying the second fluid, wherein the first fluid and the second fluid are immiscible with respect to each other, wherein contacting the first fluid with the second fluid includes entraining the second fluid within the first fluid; and solidifying the second fluid.

2. The method of claim 1, wherein the first fluid includes a non-polar material and the second fluid includes a polar material.

3. The method of claim 2, wherein the first fluid includes at least hydrocarbon oil, aromatic oil, fluorinated oil, or silicone oil.

4. The method of claim 2, wherein the second fluid includes at least water, acidic acid, formic acid, carbocyclic acids, sulfuric acid, ethylene glycol, polyethylene glycol, tert-butyl, or DMSO.

5. The method of claim 1, wherein the first fluid includes a polar material and the second fluid includes a non-polar material.

6. The method of claim 5, wherein the first fluid includes at least water, alcohol, propylene glycol, ethylene glycol, DMSO, ammonia, or nitric acid.

7. The method of claim 5, wherein the second fluid includes at least fluorinated oil, cresol, high molecular weight silicon oil, high molecular weight hydrocarbon oil, high molecular weight paraffin, thermoset polymer, or metallic alloy.

8. The method of claim 5, wherein the first fluid includes water and the second fluid includes at least high-molecular weight paraffin or thermoset polymer.

9. The method of claim 1, wherein the first fluid includes aromatic oil and the second fluid includes water.

10. The method of claim 1, further comprising cooling the first fluid before entraining the second fluid within the first fluid.

11. The method of claim 1, wherein the first fluid and the second fluid are cooled simultaneously.

12. The method of claim 1, wherein entraining the second fluid within the first fluid includes flowing the first fluid and the second fluid through a coil to solidify at least a portion of the second fluid.

13. The method of claim 12, wherein one or more hydrodynamic properties of the first fluid form the second fluid into one or more solidified shapes.

14. The method of claim 13, wherein the one or more solidified shapes are formed with at least a predictable size or a predictable shape.

15. The method of claim 14, wherein one or more features of the coil control the one or more hydrodynamic properties of the first fluid that form the second fluid into the one or more solidified shapes formed with at least the predictable size or the predictable shape.

16. The method of claim 15, wherein the one or more features of the coil include at least one or more diameters of the coil, one or more geometries of the coil, one or more interior structures of the coil, one or more orientations of the coil, or one or more lengths of the coil.

17. The method of claim 15, wherein the one or more features of the coil include a change in orientation of the coil.

18. The method of claim 15, wherein the one or more features of the coil include a change in diameter of the coil.

19. The method of claim 1, wherein entraining the second fluid within the first fluid includes introducing the second fluid as a parallel flow to the first fluid.

20. The method of claim 1, wherein entraining the second fluid within the first fluid includes introducing the second fluid as a perpendicular flow to the first fluid.

21. The method of claim 1, wherein contacting the first fluid with the second fluid includes introducing the first fluid and the second fluid with respect to one or more cold surfaces, wherein the first fluid has an affinity for the one or more cold surfaces.

22. The method of claim 21, further comprising removing a solidified form of the second fluid from the one or more cold surfaces.

23. The method of claim 21, wherein the first fluid coats at least a portion of the one or more cold surfaces and interferes with the second fluid from adhering to the one or more cold surfaces.

24. The method of claim 21, wherein contacting the first fluid with the second fluid includes mixing the second fluid with the first fluid before introducing the first fluid and the second fluid with respect to the one or more cold surfaces.

25. The method of claim 21, wherein contacting the first fluid with the second fluid includes separately introducing the first fluid and the second fluid with respect to the one or more cold surfaces.

26. The method of claim 21, wherein the one or more cold surfaces are comprised of a metal.

27. The method of claim 22, wherein removing the solidified form of the second fluid from the one or more cold surfaces includes utilizing an auger to remove the solidified form of the second fluid from a cylindrically-shaped cold surface.

28. The method of claim 22, wherein removing the solidified form of the second fluid from the one or more cold surfaces includes utilizing a rotating scrapper to remove the solidified form of the second fluid from a drum-shaped cold surface.

29. The method of claim 22, wherein removing the solidified form of the second fluid from the one or more cold surfaces includes utilizing one or more linear scrappers to remove the solidified form of the second fluid from one or more planar cold surfaces.

30. The method of claim 21, wherein the first fluid includes hydrocarbon oil and the second fluid includes water.

* * * * *